US008091300B2

(12) United States Patent
Pyo

(10) Patent No.: US 8,091,300 B2
(45) Date of Patent: Jan. 10, 2012

(54) MODULAR BUILDING BLOCKS SYSTEM AND METHOD OF MANUFACTURE

(76) Inventor: John M. Pyo, San Luis Obispo, CA (US)

( * ) Notice: Subject to any disclaimer, the term of this patent is extended or adjusted under 35 U.S.C. 154(b) by 0 days.

(21) Appl. No.: 12/825,008

(22) Filed: Jun. 28, 2010

(65) Prior Publication Data

US 2010/0319279 A1 Dec. 23, 2010

Related U.S. Application Data

(63) Continuation-in-part of application No. 11/557,956, filed on Nov. 8, 2006, now Pat. No. 7,743,565.

(51) Int. Cl.
*E04C 2/52* (2006.01)
*E04H 1/00* (2006.01)

(52) U.S. Cl. ..... 52/220.2; 52/220.3; 52/79.7; 52/79.9

(58) Field of Classification Search ..... 52/220.2, 52/220.3, 79.7, 79.9, 220.1, 220.7, 287.1, 52/288.1

See application file for complete search history.

(56) References Cited

U.S. PATENT DOCUMENTS

| | | | |
|---|---|---|---|
| 950,140 | A | 2/1910 | Lucke |
| 1,836,408 | A | 12/1931 | Sutton |
| 1,981,324 | A | 11/1934 | Peterson |
| 2,010,294 | A | 8/1935 | Dovell |
| 4,154,030 | A | 5/1979 | Huguet |
| 4,694,624 | A | 9/1987 | Juhas |
| 4,854,097 | A | 8/1989 | Haener |
| 4,884,382 | A | 12/1989 | Horbin |
| 5,182,884 | A | 2/1993 | Tarics |
| 5,881,511 | A | 3/1999 | Keller, Jr. |
| 5,964,067 | A | 10/1999 | Lehner et al. |
| 6,112,473 | A | 9/2000 | Pingel |
| 6,962,028 | B2 | 11/2005 | Banova |
| 2003/0167715 | A1 | 9/2003 | Messenger et al. |

OTHER PUBLICATIONS

Final Office Action from U.S. Appl. No. 11/557,956 mailed Oct. 26, 2009.
Final Office Action from U.S. Appl. No. 11/557,956 mailed Dec. 8, 2008.
Non Final Office Action from May 14, 2009.
Notice of Allowance from U.S. Appl. No. 11/557,956 mailed Feb. 18, 2010.
Int'l Searching Authority, *International Search Report and Written Opinion of the International Searching Authority for PCTUS0783999 mailed Jul. 11, 2008.*
Pyo, U.S. Appl. No. 11/557,956, filed Nov. 8, 2006.
Shaikh, Fattah A, "PCI Design Handbook Precast and Prestressed Concrete", 5th Edition, pp. 9-51-9-56.

(Continued)

*Primary Examiner* — Eileen D Lillis
*Assistant Examiner* — Mark Wendell
(74) *Attorney, Agent, or Firm* — Thomas F. Lebens; Sinsheimer Juhnke Lebens & McIvor, LLP

(57) ABSTRACT

A block for use in a building panel includes a plurality of layer components. Each of the layer components is separately formed from the others. Each of the layer components provides a load-bearing support function, an environmental protection function, and/or a utility function. The constructive material used to form each of the layer components and a configuration of each of the layer components are selected so as to allow the building panel to meet at least one predetermined criteria when the block is disposed in the building panel and coupled to other blocks.

24 Claims, 32 Drawing Sheets

OTHER PUBLICATIONS

Office Action from U.S. Appl. No. 11/557,956 mailed Jun. 17, 2008.
Bailey Bridge from Wikipedia (4 pages), Provided Mar. 2, 2011.
The Engineer Hrista Stamenkovic Proposal for Triangular Reinforcement of Support Walls, Vladimir Radojicie, Aug. 21, 2008 (5 pages).
ICC-ES Evaluation Report; ESR-1792 reissued Jun. 1, 2009; www.icc-es.org, (7 pages).
ICC-ES Evaluation Report; ESR-1746 reissued Nov. 1, 2009; www.icc-es.org, (4 pages).
Segmental Bridge—Wikipedia, the free encyclopedia; (4 pages), Provided Mar. 2, 2011.
Cosmos/M bridges the gap; Desktop Engineering, Mabey & Johnson, Case Study; (2 pages), Provided Mar. 2, 2011.
Sir Donald Bailey's Bridge, (6 pages), Provided Mar. 2, 2011.

MODULAR BUILDING BLOCKS SYSTEM AND METHOD OF MANUFACTURE

CROSS REFERENCE TO RELATED APPLICATION

This application is a continuation-in-part application of U.S. application Ser. No. 11/557,956, filed Nov. 8, 2006, now U.S. Pat. No. 7,743,565 and entitled "Modular Building Block System and Method of Manufacture," which is incorporated herein by reference in its entirety.

FIELD OF THE INVENTION

The field of the invention relates to building materials and, more specifically, to components used to construct building panels and other building structures.

BACKGROUND OF THE INVENTION

Home buyers of today demand products that are cost-effective, flexible in use, and visually pleasing. In addition, home buyers desire an immense variety of choice in the areas of architectural styles and floor plans. For instance, some buyers may desire homes with traditional floor plans and construction materials while others may prefer more contemporary styles and materials.

In the construction industry, the cost of materials, labor, and land are some factors that are typically taken into account when constructing a building or other structure. In order to reduce the cost of some or all of these factors and still meet the demands of buyers, various materials have been developed such as cement board siding, high efficiency energy saving windows, and engineered wood products. In other examples, prefabrication techniques have been used to construct homes in factories.

Unfortunately, the previous materials, products, and approaches described above have not necessarily decreased the cost of constructing buildings and still meet the design needs of customers. For instance, prefabrication approaches can only provide design versatility at the expense of high fabrication costs. In addition, the quality of the home constructed using such techniques is often inadequate due to the necessity of using low cost materials to reduce the overall home cost. As a result of these problems, previous approaches for home construction have proven inadequate to provide a cost-effective product while at the same time meeting the design requirements of consumers.

SUMMARY OF THE INVENTION

A modular building block is provided that facilitates the construction of cost-effective building structures while at the same time providing a wide variety of design choices for consumers. Structures utilizing these blocks are also provided. A method of manufacturing these blocks is also provided along with an automated ordering, manufacturing, and distribution process allowing a customer to place an order for a building block having a specific structure and allowing the building block to be automatically manufactured and delivered to an end user (e.g., a construction contractor).

As mentioned, the blocks may be assembled into a variety of different structures. The same configuration of blocks need not be used throughout the entire structure (i.e., the function of particular blocks used in the structure may vary from location to location within the structure). Consequently, blocks providing structural reinforcement properties or resistive to certain forces may be used in some portions of the structure while other blocks having other or different properties may be used in other areas of the structure. In so doing, great flexibility is provided in designing a particular structure and costs are significantly decreased since the same type of block does not necessarily have to be used throughout the entire structure. Additionally, when assembled into a structure no additional support (or other types) of materials are needed to complete the structure (i.e., the assembled block structure is the entire structure).

The blocks can be used in a wide variety of structures such as the walls of buildings. The walls provide shelter and protection for building occupants, contribute to structural strength of the building as a whole, and facilitate the integration of auxiliary systems (e.g., electrical or plumbing systems). Other examples of structures and functions may also be provided.

In addition to being used to form building walls, the blocks can be used in floor, roof, foundation, or other types of assemblies. The assemblies formed can be precut, preassembled, and easily shipped to job sites where the assemblies can be easily incorporated into buildings or other structures.

The materials, blocks, design processes, manufacturing processes, and distribution processes described herein can also be used in any type of building, storage vessel, bridge, retaining walls and levees, aerospace structure, or high rise structure. The structures and processes described herein also facilitate the fabrication of complex shapes such as domes, cylinders, spheres, and cones. Corners and intersections can also be prefabricated as well as trims for door and window openings or end of wall terminations. In another example, a component panel arrangement could provide air/space for conventional integration of plumbing components, electrical components, insulation components, or other types of components.

In some these embodiments, a block for use in a building panel includes a plurality of layer components. Each of the layer components is separately formed from the others. Each of the layer components provides a load-bearing support function, an environmental protection function, and/or a utility function to mention a few examples. The constructive material used to form each of the layer components and a configuration of each of the layer components are selected so as to allow the building panel to meet at least one predetermined criteria when the block is disposed in the building panel and coupled to other blocks.

The predetermined criteria may relate to or be any number of requirements. For example, the predetermined criteria may be a structural support requirement, an environmental protection requirement, a utility conduit requirement, and an aesthetic requirement. Other examples or types of criteria are possible.

The constructive material of each layer component may be selected to resist a force or forces. For example, these forces to which resistance may be provided may include bending forces, tension forces, compression forces, torsion forces, shear forces, and/or thermal forces. Other examples of forces are possible and these may be resisted as well.

In some of these embodiments, at least one of the layer components is a protective layer. The constructive material of the protective layer may be a vapor barrier material, a waterproofing barrier material, and a breathable wrap material to mention a few examples.

In other embodiments, at least one of the layer components is a utility component. The utility component may be insulation, an electrical conduit, and a plumbing conduit to mention a few examples.

In still others of these embodiments, one of the layer components is a load bearing component. The load bearing component may be constructed from a material such as steel, plywood, plastic, fiberglass, and concrete. Other examples of materials may also be used.

In others of these embodiments, a building panel includes a plurality of blocks coupled together via a plurality of coupling mechanisms. The blocks are coupled together directly via the coupling mechanisms and without the use of an intervening building structure (such as a wooden board). Each of the plurality of blocks includes a plurality of layer components. Each of the layer components is separately formed from the others and each of the layer components provides a building function within the building panel. The building function may be a load-bearing support function, an environmental protective function, and/or a utility function to mention a few examples. A constructive material and a configuration of each of the layer components are selected to allow the building panel to meet at least one predetermined criteria when each of the blocks is disposed in the building panel and coupled to other blocks.

The coupling arrangements may be any number of mechanisms and may be configured in a variety of different ways. For example, at least some of the coupling mechanisms may be a locking pin arrangement. Other examples of coupling mechanisms are possible.

The building panel so provided according to the present approaches may be any number of different construction elements or structure. For example, the building panel may be a wall panel, a truss, a floor panel, an interior load bearing panel, an exterior load bearing panel, an interior non-load bearing panel, an exterior non-load bearing panel, and a floor. Other examples of structures are possible.

In others of the embodiments, a block for use in a building panel includes a first layer component, a second layer component, and a third layer component. The different layer components may be separately formed from the others. The first layer component is configured to provide a first building function and the first layer component being constructed from a first material.

The second layer component is formed separately from the first layer component and is connected to the first layer component. The second layer component is configured to provide a second building function and the second layer component is constructed from a second material.

The third layer component is formed separately from the first layer component and the second layer component. The third layer component is connected to the second layer component and is configured to provide a third building function. The third layer component is constructed from a third material.

The second layer component is disposed between the first layer component and the third layer component. The first building function, the second building function, and the third building function may be a load-bearing support function, an environmental protection function, and/or a utility function. Other examples are possible.

The constructive material and a configuration of each of the first layer component, the second layer component, and the third layer component are selected to allow the building panel to meet at least one predetermined criteria when the block is disposed in the building panel and coupled to other blocks.

The predetermined criteria may be or relate to any number of requirements. For example, the predetermined criteria may be a structural support requirement, an environmental protection requirement, a utility conduit requirement, and/or an aesthetic requirement. Other examples are possible.

In others of these embodiments, at least one of the first material, the second material, and the third material is selected to resist a force. The force may be a bending force, a tension force, a compression force, a torsion force, a shear force, and/or a thermal force. Other examples of forces are possible.

In some examples, at least one of the first layer component, second layer component, and third layer component is a protective layer. The protective layer may be a vapor barrier material, a waterproofing barrier material, a durable barrier material, and/or a breathable wrap. Other examples of protective layers are possible.

In still other examples, at least one of the first layer component, second layer component, and third layer component is a utility component. The utility component may be insulation, an electrical conduit, and/or a plumbing conduit. Other examples are possible.

In yet other embodiments, at least one of the first layer component, second layer component, and third layer component is a load bearing component. The load bearing component may be constructed from a material selected such as steel, plywood, plastic, fiber glass and concrete. Other examples are possible. In some examples, the first material, second material, and third material are different from the others. In other examples, at least two of the first material, second material, and third material are constructed from the same material.

Various coupling arrangements may be provided to couple the components of the building block together. For example, the coupling arrangements may utilize one or more coupling pins, braces, and/or brackets. Other types of coupling arrangements may also be used. The coupling elements provide a rigid connection between the blocks.

In another example, the blocks can be assembled end-to end into a beam or truss. In this regard, the blocks provide resistance to a load force acting on the beam and require no additional components to provide this force or load resistance.

Multiple functions are integrated into the same block. For example, structural support, protective functions (e.g., occupant safety and protection from the environment) and utility functions can be integrated into the same block.

Advantageously, the above described approaches have a high degree of design and structural flexibility and are customizable and not limited to specific architectural designs or floor plans. Material, labor, and construction costs are reduced. The present approaches also allow for structural openings (e.g., windows and doors) to be placed almost anywhere in the structure while maintaining structural integrity. The building blocks can be fabricated using automated processes and entire buildings can be prefabricated as building blocks, precut, marked, and palletized for shipping. The use of scarce resources (e.g., lumber) can also be reduced by using these approaches. Moreover, constructing a building is greatly simplified and the cost is reduced. Furthermore, various types of computer software or computer processes may facilitate the design, fabrication, delivery, and construction processes. When assembled into structure, the blocks provided herein provide the above-mentioned functions (e.g., structural integrity) without the use of additional structures, elements, and/or materials.

Figure 1A:
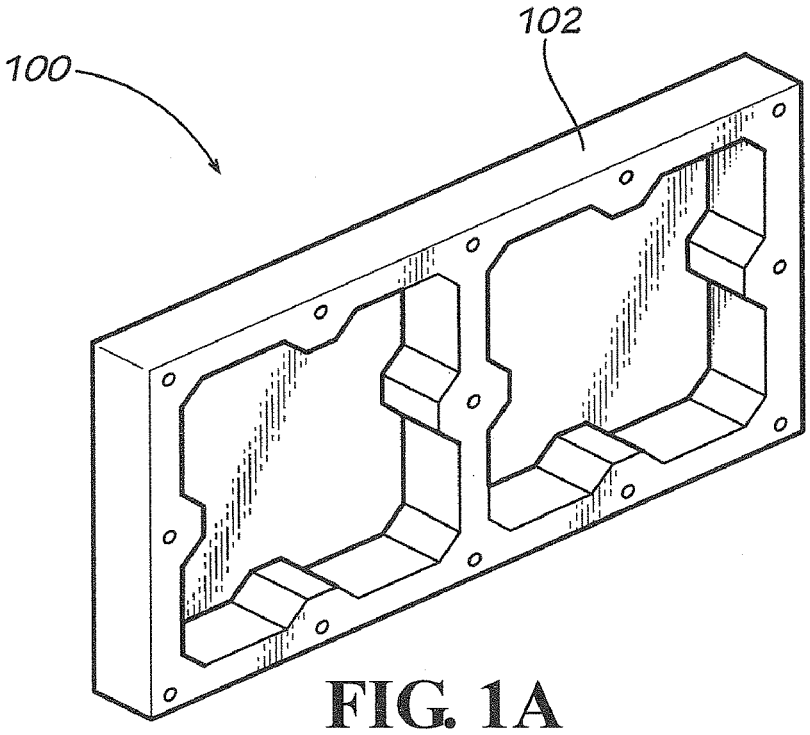
FIGS. 1*a-f* are perspective views of a block comprising various components according to the present invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION OF THE PREFERRED EMBODIMENTS

As used herein, "truss" denotes a structure comprised of one or more triangular units (constructed with straight members), and whose ends are connected at joints (also referred as nodes). External forces and the reactions to these forces are considered to act only at the nodes and result in forces in the structural members to be either tensile or compressive forces.

As used herein, the term "space frame" denotes a system of structural members arranged in three-dimensional structural groups. The three-dimensional arrangement makes the space frame more dimensionally stable because it can be designed to support (or resist) forces in any direction. A space truss may use triangulated units in three-dimensions. Consequently, a space frame is not necessarily a space truss (although in some situations in may be).

Many of the examples provided herein are space frames. They utilize planer trusses in two dimensions but uses moment connections in the third dimension. The individual blocks may uses planer trusses or may be "truss-like."

As used herein a "moment" is a force that causes rotation or has tendency to cause rotation. Shear and bending forces occur with moment connections. A torsion is the twisting of an object due to an applied moment. A "bending" (also known as flexure) characterizes the behavior of a slender structural element subjected to an external load applied perpendicularly to a longitudinal axis of the element. When the length is considerably longer than the width and the thickness, the element is called a beam. A closet rod sagging under the weight of clothes on clothes hangers is an example of a beam experiencing bending.

As used herein, a "shear stress" is a stress which is applied parallel or tangential to a face of a material, as opposed to a normal stress which is applied perpendicularly. Shear walls are a type of structural system that provides lateral resistance to a building or structure. They resist "in-plane" loads that are applied along its height. The applied load is generally transferred to the wall by a diaphragm or collector or drag member. For example, they are built in wood, concrete, and CMU (masonry).

As used herein, "compression" is the result of the subjection of a material to compressive stress, resulting in reduction of volume. The opposite of compression is tension. Compression is a pushing force. "Compressive stress" is the stress that, when applied, acts towards the center of that material. When a material is subjected to compressive stress, then this material is under compression. Usually, compressive stress applied to bars, columns, and so forth and leads to shortening.

As used herein, "tension" is the magnitude of the pulling force exerted by a string, cable, chain, or similar object on another object. Tension is a pulling force. "Tensile stress" (also referred to as normal stress or tension) is the stress state leading to expansion; that is, the tensile stress may be increased until the reach of tensile strength, namely the limit state of stress.

Referring now to FIGS. 1*a-f*, one example of a building block 100 that includes various types of components, panels, or layers is described. In this example, the building block 100 includes load bearing components and building services components. The building services components may provide a variety of functions. For example, the building service components may provide seismic protection, vapor protection, electrical functions, and or/plumbing functions. The load bearing and building services components may be coupled together with any type of coupling arrangement such as connector pins. It will be appreciated that other examples of blocks with other types of internal components are possible and that the various components may be arranged or internally connected within the block in a variety of different ways. For example, although the components of FIGS. 1*a-f* are shown as positioned one next to the other in a layered fashion, these components may be positioned in other ways, angles, and positions (e.g., at right angles to the others to form a box-like structure).

Figure 1B:
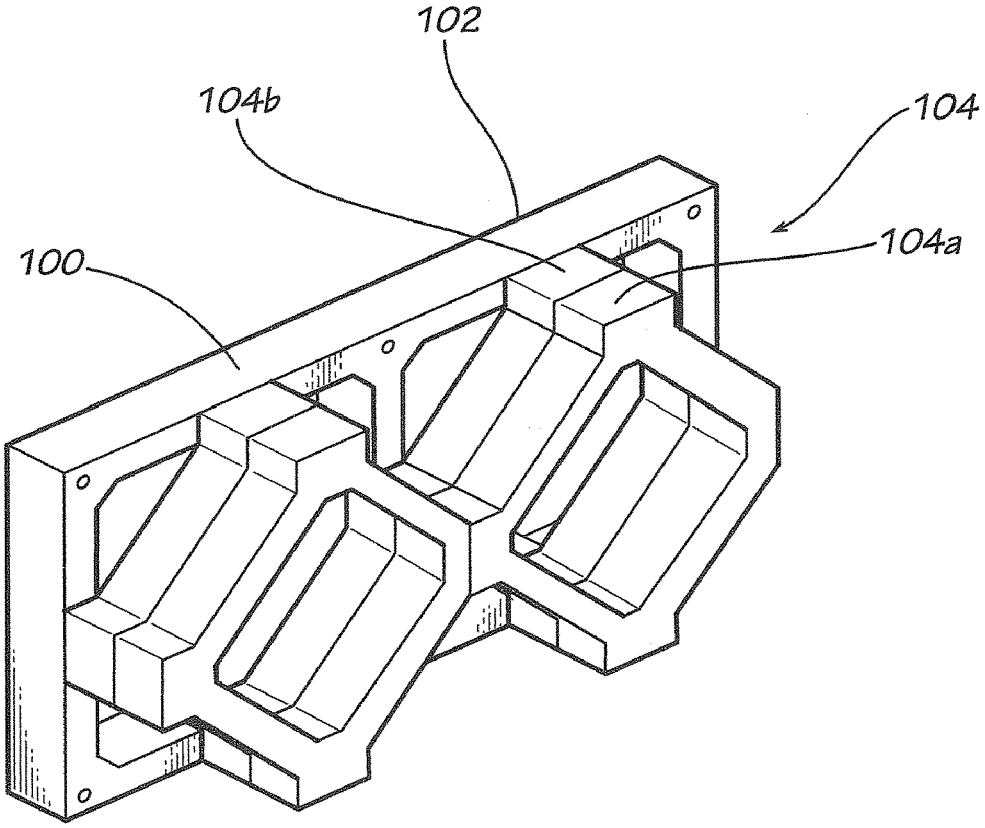

Referring now specifically to FIG. 1*a-b*, one example of a portion of a building block 100 is described. An outer component 102 in the form of a flat panel is positioned at and forms one side of the building block 100. The outer component 102 may be constructed of any suitable material such as cement (e.g., Portland cement), woods, woven wire, plastics, metals, Calcium Aluminate Cement (CAC) or any combination of these or other materials. Polymers, reducers, and specialized aggregates can be used as ingredients of these materials. These materials provide for rigidity and compressive strength. In some cases, the outer component 102 may be used as formwork for poured-in-place concrete.

When cement is used, the components may be formed using the hot mold casting technique as described herein. Using this technique advantageously speeds the chemical reactions used in cement resulting in faster production using less space. It will be appreciated that the hot mold casting described herein may also be used for the production of other construction-related items such as roof tile (e.g., simulated wood shake), floor tile, architectural stone casting, pottery, or cultured stone veneers.

As mentioned, various types of aggregates may also be used to form the components of the block. In one example, a Wollastonite aggregate with a high aspect length to diameter (e.g., 15:1) is used. Ceramic microspheres may be used in any of the materials to provide weight reduction.

In one example, a batch of material may be formed for use in block components that includes seven pounds of Portland cement, three pounds of Calcium Aluminate Cement, 1 pound of Pozzolin (highly reactive metakaolin) and a microfiber aggregate (e.g., nyad g, Wollastonite). In addition, 0.1 pounds of fiber reinforcement (e.g., a polyvinyl acetate fiber) and glass spheres (e.g., 3m Scotchlite) may be used. The batch may be 0.43% water, use 0.2 pounds of a polymer admix (e.g., Vinnepas 5044n), be 0.2% retarder (e.g., citric acid), be 2.25% water reducer (e.g., Melflux 2651), be 1% accelerator (e.g., lithium carbonate), and include a Rheological stabilizer such as Melvis 200.

In another example, a calcium sulfo-aluminate cement may be used. This cement is specifically manufactured as a rapid setting, high early strength cement. Higher compressive strengths can be achieved with this type of cement, and may be less detrimental to the environment as a result of manufacturing methods.

With the use of polyvinyl acetate fibers (pva) a polymer additive is preferably not used. With other types of fibers such as glass, a polymer may be used. Additionally, Portland cement can be replaced with either type-f or type-c fly ash (having a compositional range of 10 to 40% of total Portland cement). Further, a Pozzolan type reaction can be created, in addition to the typical reactions of the cement, with the introduction of various types of materials such as silica fume, reactive metakaolin, or micron 3.

In another example of a mix, 160 pounds of material (mix) may be created. In this example, the mix includes 60 pounds of Portland cement; 20 pounds of calcium aluminate cement; 20 pounds of fly ash; 10 pounds of reactive metakaolin; 15 pounds of calcium silicate (e.g., Nyad G Wollastonite used as a microfiber aggregate); 35-42 pounds of water (e.g., 0.35-0.42 water/cement). In this approach, the mix is 1-1.5% high range water reducer (e.g., Melflux 2651) by weight of cementatious material; 0.05-1% accelerator (e.g., lithium carbonate) by weight of cementatious material; and 0.05-5% Rheological stabilizer (e.g., Melvis 200) by weight of cementatious material.

A reinforcing component 104 is placed parallel to and then coupled to the outer component 102. Additionally, the reinforcing component 104, in one example, may provide seismic relief functions. The coupling between the various components of the block may utilize pins, screws, nails, adhesive, or any suitable approach and/or material.

The reinforcing component 104 may include a first reinforcing sub-component 104*a* and a second reinforcing sub-component 104*b*. The reinforcing component 104 may be constructed using any number of patterns or structures but in one approach is constructed using a truss-like structure as described elsewhere in this specification. In one example, the trusses of the reinforcing component 104 may be formed from concrete that are reinforced with metal rods, wires, roping, or fibers. The type and diameter of the reinforcement component (e.g., fiber) used for the reinforcement along with the quality and layout of the reinforcement component provides the desired strength characteristics for the reinforcing component 104. Sheet metal panels can be used as an alternate structural bracing panel or in addition to the seismic component.

Figure 1C:
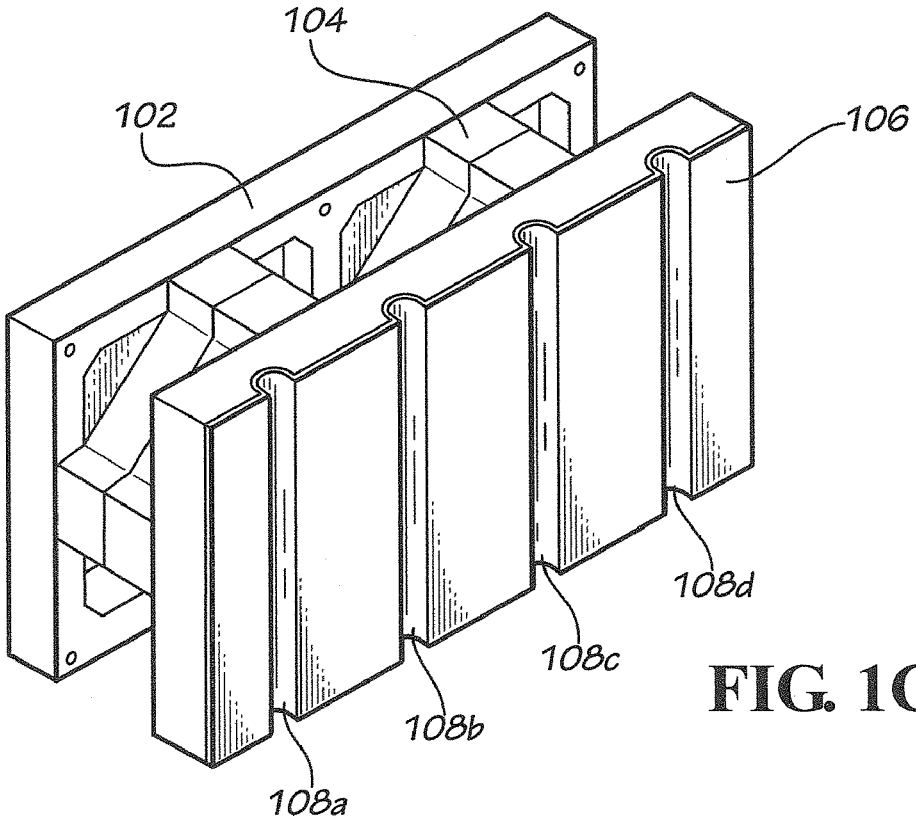
Figure 1D:
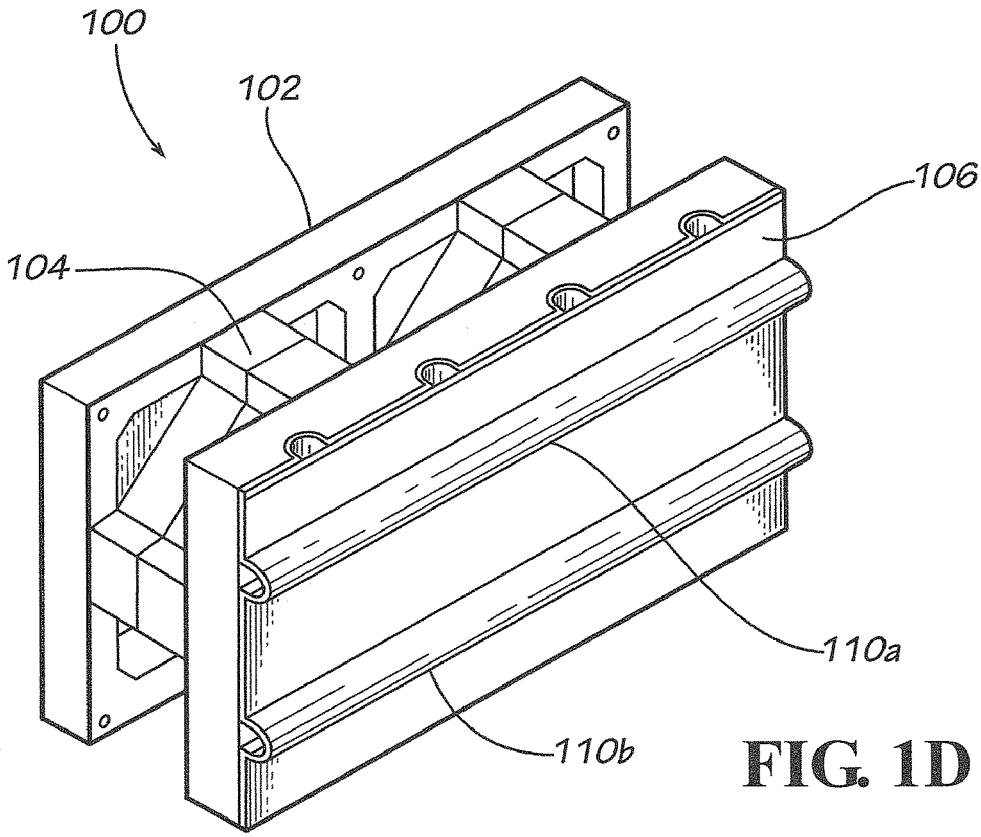

Referring now to FIGS. 1*c* and 1*d*, an insulation component 106 is attached parallel to the reinforcing component 104. The insulation component 106 includes vertical electrical conduits 108*a*, 108*b*, 108*c*, and 108*d* that extend vertically across the insulation component 106. For example, electrical wires, cables, or fibers can be placed in these vertical electrical conduits. Horizontal electrical conduits 110*a* and 110*b* are also provided and extend horizontally and in a different plane from the vertical electrical conduits 108*a*, 108*b*, 108*c*, and 108*d*. In one example, the horizontal electrical conduits 110*a* and 110*b* provide conduits for electrical wires. The conduits can be disposed in any direction (e.g., horizontal, vertical, angled). For example, a horizontal conduit and a vertical conduit can be used and these are separated to prevent interference. Coring perpendicular into the panel at a known intersecting dimension provides one approach to connect the horizontal and vertical conduit.

The vertical electrical conduits 108*a*, 108*b*, 108*c*, 108*d* and horizontal electrical conduits 110*a* and 110*b* may be in the form of pipes or pipe-like structures that are used to hold any type of electrical component such as wires, wire cables, fiber optic cables, or the like. Alternatively, the vertical electrical conduits 108*a*, 108*b*, 108*c*, 108*d* and horizontal electrical conduits 110*a* and 110*b* may be in the form of a hollow channel having any type of cross section (e.g., circular, elliptical, square, or rectangular).

In an alternate approach, the vertical electrical conduits 108*a*, 108*b*, 108*c*, 108*d* and horizontal electrical conduits 110*a* and 110*b* may be used for plumbing components to provide plumbing functions. In this case, the conduits may be pipes. Other uses for the conduits are possible. Alternatively, providing air-space between panels can be used as an alternative to the building services component to allow for the use of conventional building system approaches.

Figure 1E:
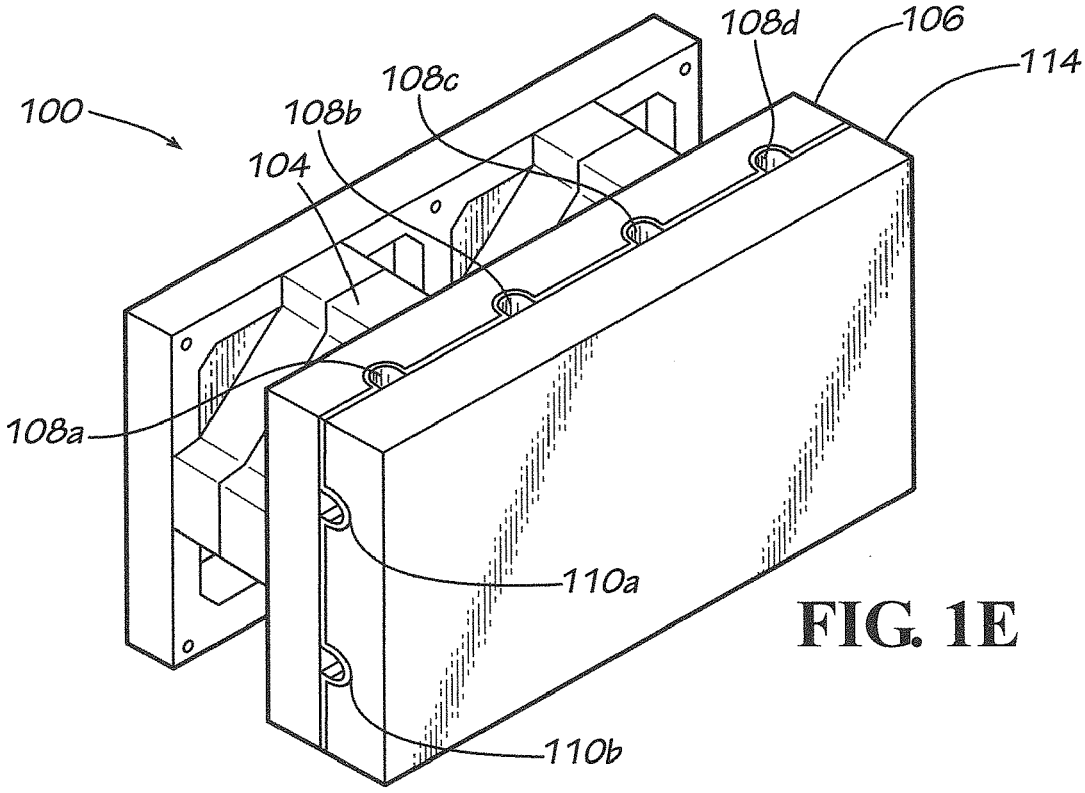

Referring now to FIG. 1*e*, a horizontal conduit component 114 is shown formed around the horizontal electrical conduits 110*a* and 110*b*. The horizontal conduit component 114 surrounds the horizontal electrical conduits 110*a* and 110*b* and may be constructed from cement, plastic, metal, or any combination of these or other materials.

Figure 1F:
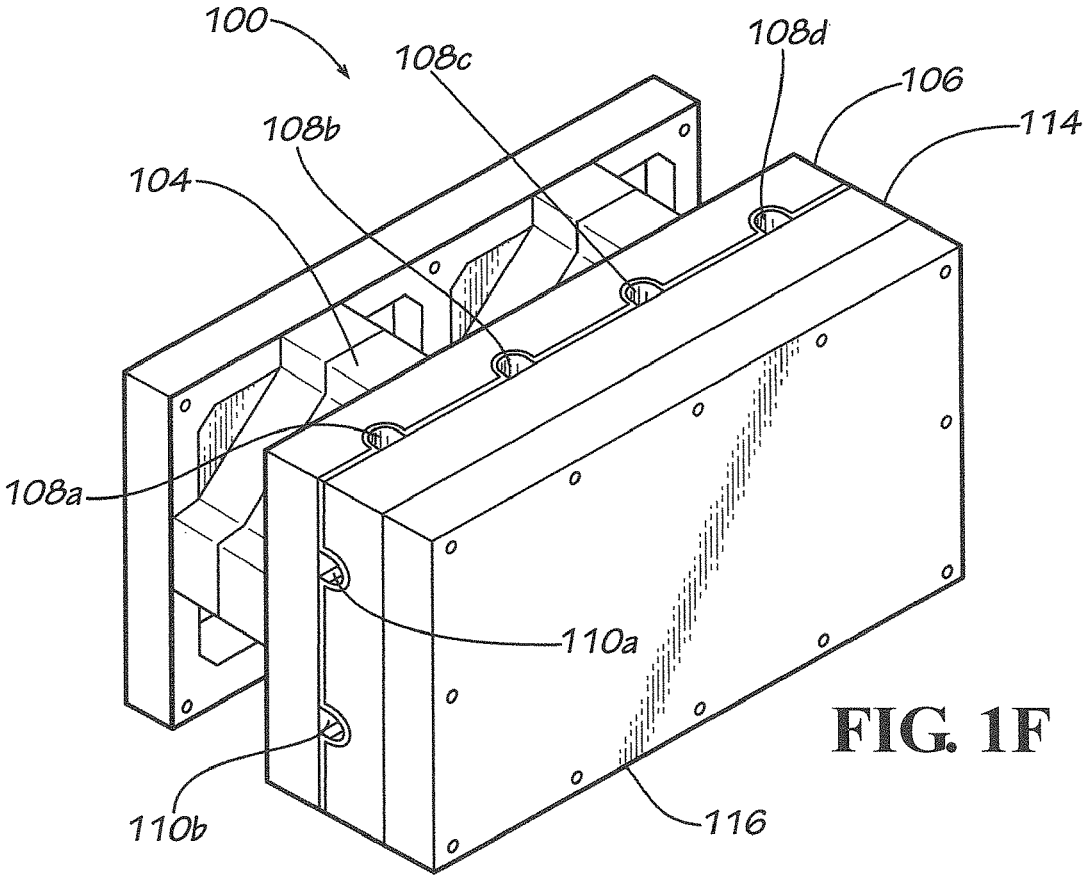

Referring now to FIG. 1*f*, a second side component 116 is coupled parallel to the horizontal conduit component 114. As with the outer component 102, the second side component 116 may be constructed using cement, plastic, metal, or any combination of these or other materials. Any of the components mentioned above may be coupled to the other component using pins, screws, nails, adhesive, or any suitable approach and/or material.

Figure 2A:
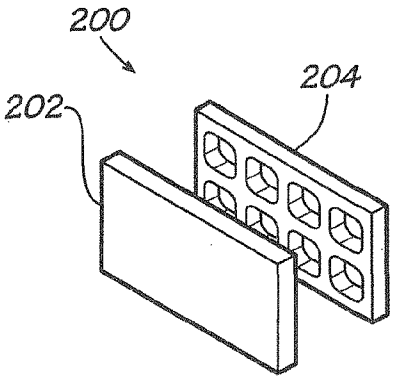
FIGS. 2*a-g* are examples of various types of blocks comprising various components according to the present invention.

Referring now to FIG. 2*a*, another example of a block 200 is described. The block 200 comprises an outside component 202 and an inside component 204 that are coupled together so as to be parallel to each other. The outside component 202 and inside component 204 are coupled together using any suitable coupling arrangement (e.g., coupling pins) (not shown) and may be load bearing and/or non-load bearing components. The outside component 202 and inside component 204 may be constructed of any suitable material such as cement (e.g., Portland cement), woods, woven wire, plastics, metals, CAC or any combination of these or other materials. Polymers, reducers, and specialized aggregates can be used as ingredients of these materials. These materials provide for rigidity and compressive strength of the outside component 202 and inside component 204. The components 202 and/or 204 may be vertical load bearing components, or protective shell components.

Figure 2B:
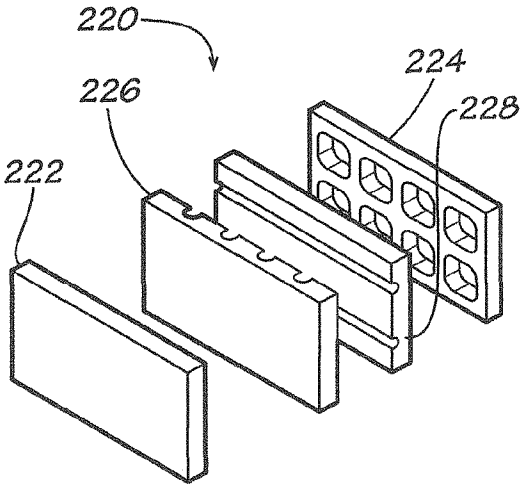

Referring now to FIG. 2*b*, another example of a block 220 is described. This block provides a non-load bearing assembly with the integration of external systems (e.g., electrical or plumbing systems). The block 220 comprises an outside component 222 and an inside component 224. In addition, the block 220 comprises a vertical conduit component 226 and a horizontal conduit component 228. The outside component 222, inside component 224, vertical conduit component 226, and horizontal conduit component 228 may be arranged so as to be parallel to each other. Any of the outside component 222, inside component 224, vertical conduit component 226, or horizontal conduit component 228 may be constructed of any suitable material such as cement (e.g., Portland cement), woods, woven wire, plastics, metals, CAC or any combination of these or other materials. Polymers, reducers, and specialized aggregates can be used as ingredients of these materials. These materials provide rigidity and compressive strength for the components. The components are coupled together in parallel by pins or any suitable coupling arrangement (not shown). The components 222 and/or 224 may be vertical load bearing components or protective shell components.

Figure 2C:
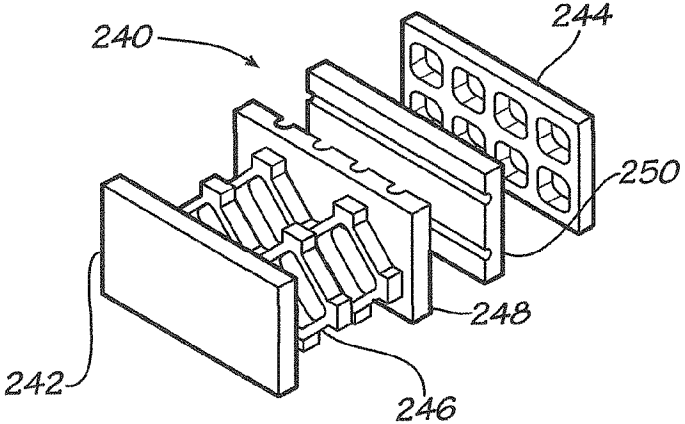

Referring now to FIG. 2*c*, another example of a block 240 is described. This block provides a load bearing assembly with the integration of external systems. The block 240 comprises an outside component 242 and an inside component 244. In addition, the block 240 comprises a seismic restraint component 246, a vertical conduit component 248 and a horizontal conduit component 250. The outside component 242, inside component 244, and horizontal conduit component 250 are connected parallel to each other. The seismic restraint component 246 is positioned between the outside component 242 and the vertical conduit component 248. The components 242 and/or 244 may be vertical load bearing components or protective shell components.

The outside component 242, inside component 244, seismic restraint component 246, vertical conduit component 248, and horizontal conduit component 250 may be constructed of any suitable material such as cement (e.g., Portland cement), woods, woven wire, plastics, metals, CAC or any combination of these or other materials. Polymers, reducers, and specialized aggregates can be used as ingredients of these materials. These materials provide for rigidity and compressive strength. The outside component 242, inside component 244, seismic restraint component 246, vertical conduit component 248, and horizontal conduit component 250 may be coupled together in parallel by pins or any suitable coupling arrangement (not shown).

The seismic restraint component 246 may be constructed using any number of patterns or configurations but in one approach is a truss-like structure as described elsewhere in this specification. In one example, the seismic restraint component 246 may be formed from concrete and reinforced with metal rods, wires, fiber, or roping. The type and diameter of the particular reinforcement used along with the quality and layout of the reinforcement provides the desired strength characteristic. The component 246 provides lateral bracing. When this block is used in conjunction with a vertical loading component, it creates a truss.

Figure 2D:
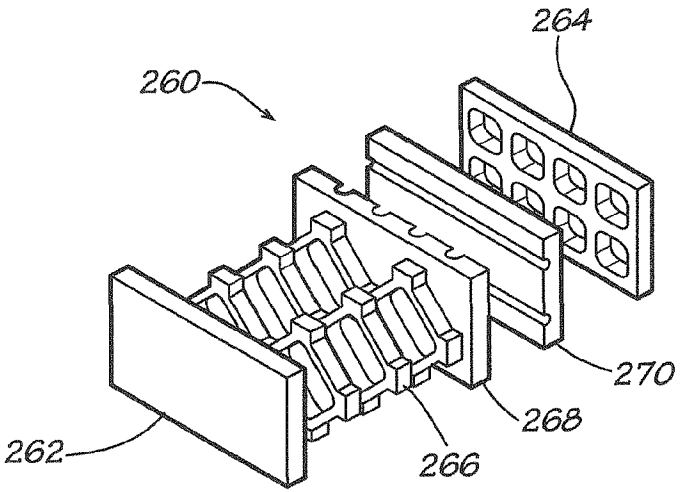

Referring now to FIG. 2*d*, another example of a block 260 is described. This block provides for the ability to handle increased structural loads with poured-in place option and auxiliary system integration. The block 260 comprises an outside component 262 and an inside component 264. In addition, the block 260 comprises a seismic restraint component 266, a vertical conduit component 268 and a horizontal conduit component 270. The outside component 262, inside component 264, vertical conduit component 268, and horizontal conduit component 270 are connected parallel to each other. The seismic restraint component 266 is positioned between the outside component 262 and the vertical conduit component 268. The components 262 and/or 264 may be vertical load bearing components and/or protective shell components.

The outside component 262, inside component 264, seismic restraint component 266, vertical conduit component 268, and horizontal conduit component 270 may be constructed of any suitable material such as cement (e.g., Portland cement), woods, woven wire, plastics, metals, CAC or any combination of these or other materials. Polymers, reducers, and specialized aggregates can be used as ingredients of these materials. These materials provide for rigidity and compressive strength. The outside component 262, inside component 264, seismic restraint component 266, vertical conduit component 268, and horizontal conduit component 270 may be coupled together in parallel by pins or any suitable coupling arrangement (not shown).

The seismic restraint component 266 is larger in size than the seismic restraint component 266 shown in FIG. 2*c* and may be constructed using any number of patterns or configurations but in one approach is a truss-like structure as described elsewhere in this specification. In one example, the seismic restraint component 266 may be formed from concrete and reinforced with metal rods, wires, fiber, or roping. The type and diameter of the particular reinforcements used along with the quality and layout of the reinforcements provides the desired strength characteristic. The component 266 provides lateral bracing. When used in conjunction with a vertical loading component, it creates a truss.

Figure 2E:
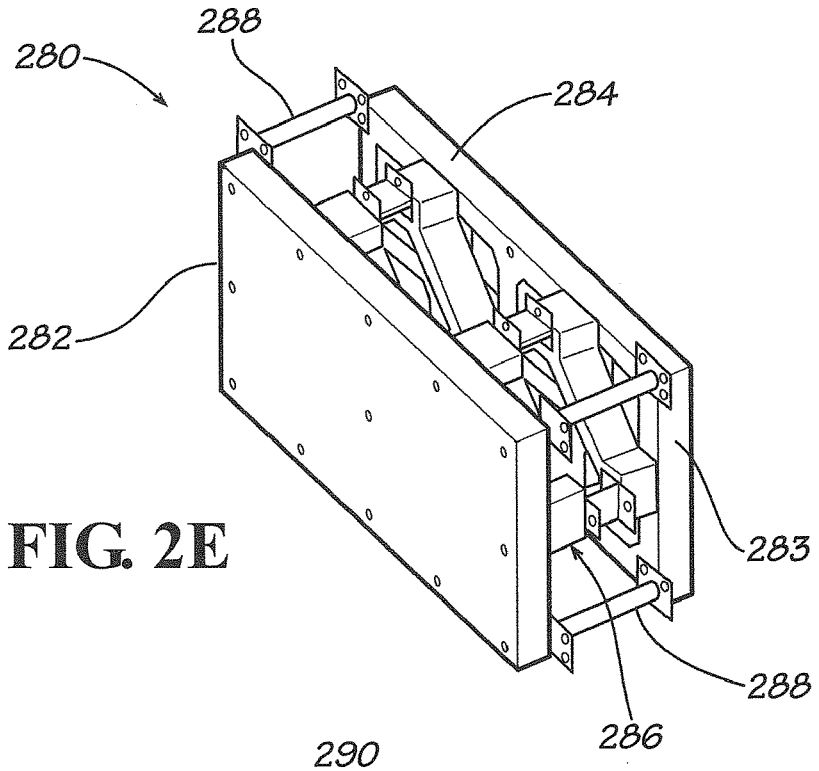

Referring now to FIG. 2*e*, another example of a block 280 is described. The block 280 comprises an outside component 282 and an inside component 284. The outside component 282 and the inside component 284 may be coupled so as to be parallel to each other. In addition, the block 280 comprises a seismic restraint component 286, which is positioned between the outside component 282 and the inside component 284. The components are held together by coupling pins 288.

The outside component 282, inside component 284, seismic restraint component 286 may be constructed of any suitable material such as cement (e.g., Portland cement), woods, woven wire, plastics, metals, CAC or any combination of these or other materials. Polymers, reducers, and specialized aggregates can be used as ingredients of these materials. These materials provide for rigidity and compressive strength. The components may be coupled together by pins or any suitable coupling arrangement.

The seismic restraint component 286 may be constructed using any number of patterns or configurations but in one approach is a truss-like structure as described elsewhere in this specification. In one example, the seismic restraint component 286 may be formed from concrete and reinforced with metal rods, wires, fiber, or roping. The type and diameter of the particular reinforcement used along with the quality and layout of the reinforcement provides the desired strength characteristic.

Figure 2F:
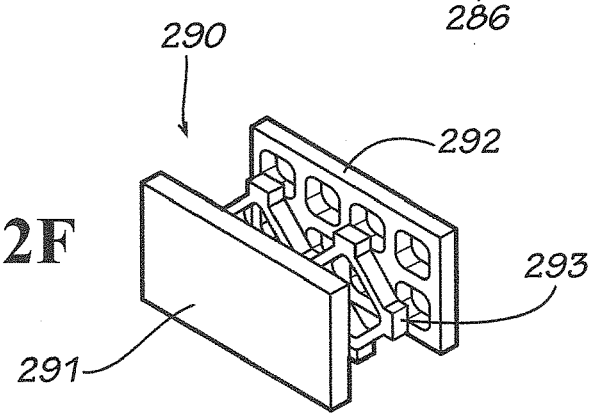

Referring now to FIG. 2*f*, another example of a block 290 is described. This block can be integrated into one panel, but doing so limits the ability to integrate other systems. The block 290 comprises an outside component 291, an inside component 292, and a seismic restraint component 293. As with the other blocks described herein, any of the outside component 291, inside component 292, or seismic relief component 293 can be constructed of any suitable material. The seismic relief component 293 provides lateral bracing. When the block is used in conjunction with vertical load bearing components, it creates a truss. The outside component 291 and inside component 292 provide vertical load bearing functionality and/or protective shell functionally.

Figure 2G:
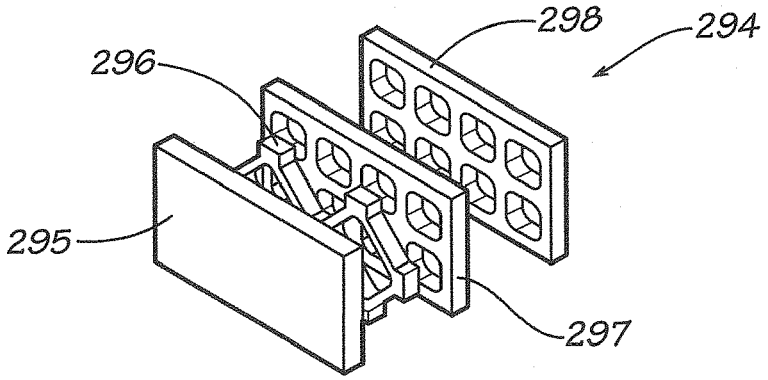
Figure 2I:
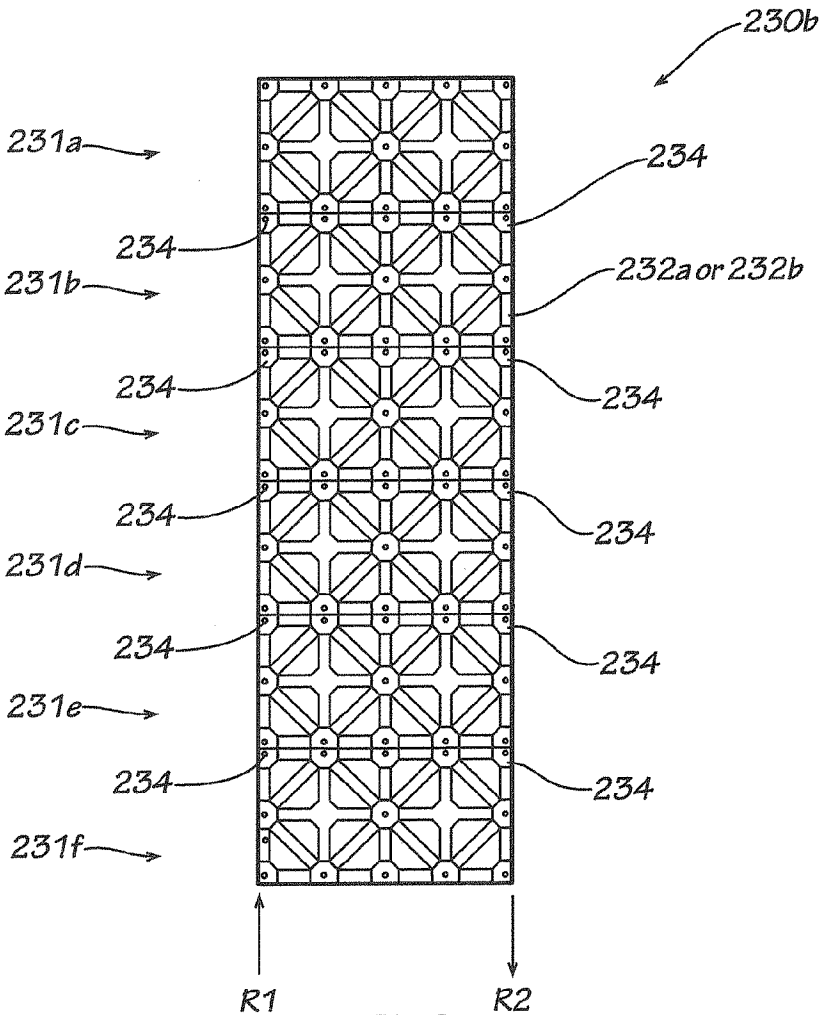
FIGS. 2*h-l* are examples of various structures formed by blocks according to the present invention.
Figure 2H:
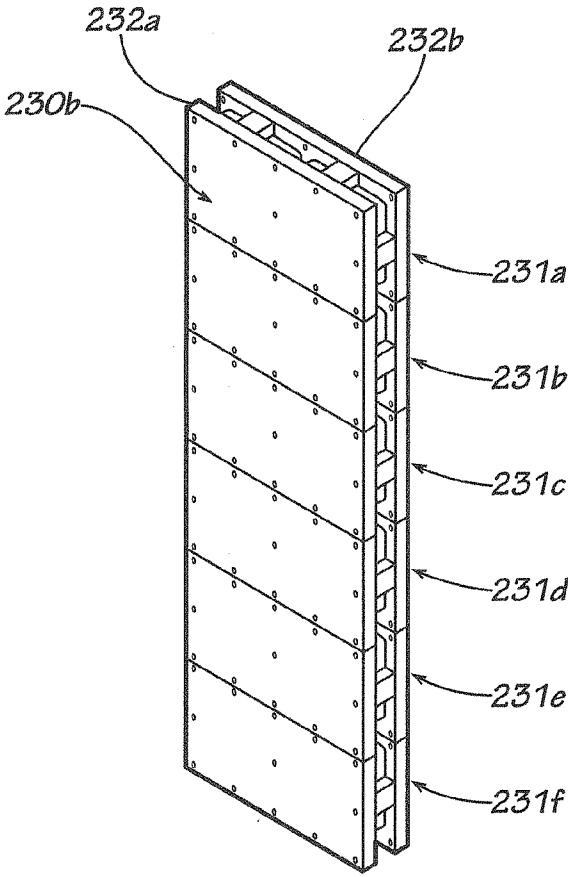

Referring now to FIG. 2*g*, another example of a block 294 is described. This block provides load bearing functions with air/space for integration into conventional systems. For instance, separation of the components with spacers provides space for poured-in-place concrete. The block 294 comprises an outer component 295, an inner component 298, a seismic restraint component 296, and an inner load bearing component 297. As with any of the other blocks described herein, any of the components may be constructed using any suitable material. The seismic relief component 296 provides lateral bracing. When the block is used in conjunction with vertical load components, it creates a truss. The outside component 295, inside component 298, and inner load bearing component 297 provide vertical load bearing function and/or protective shell functionality.

Figure 2J:
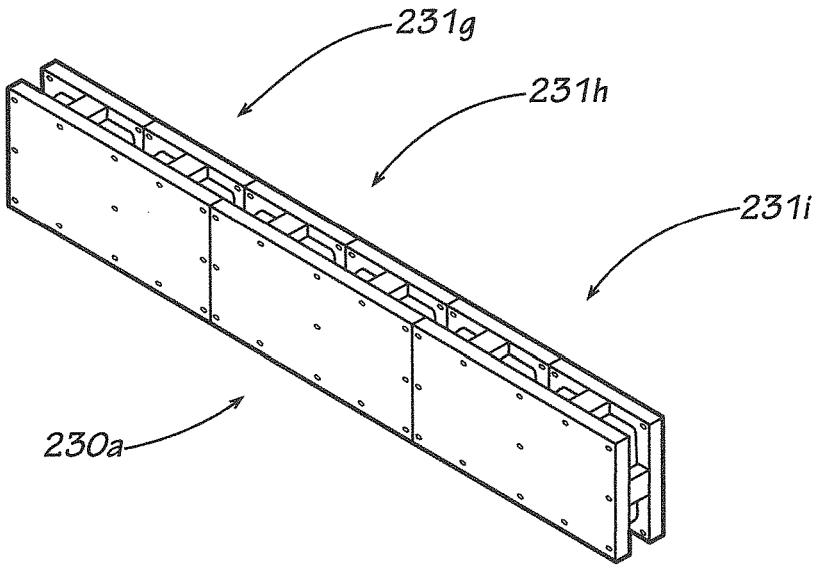
Figure 2K:
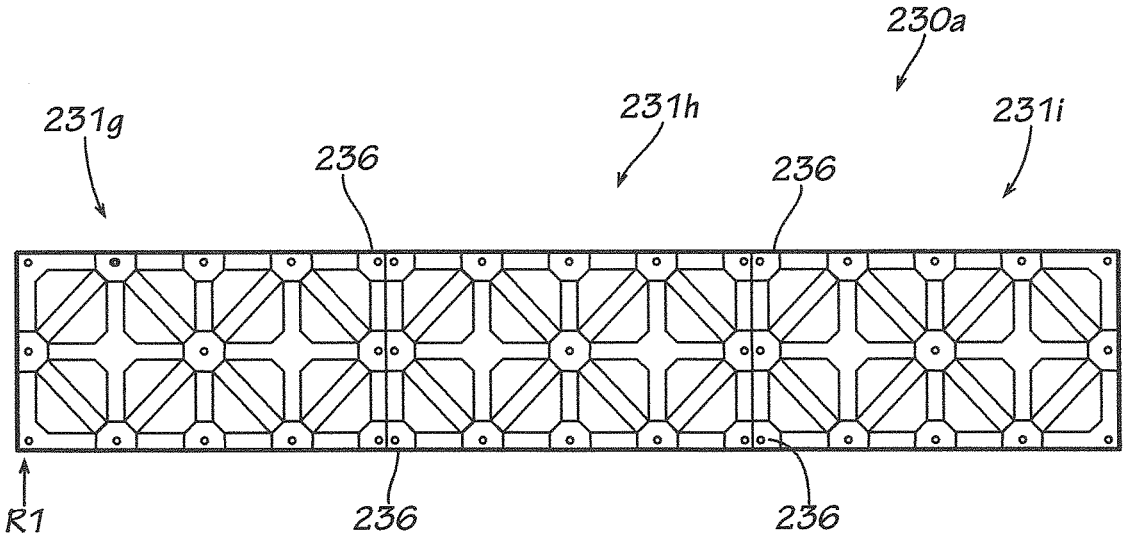
Figure 2L:
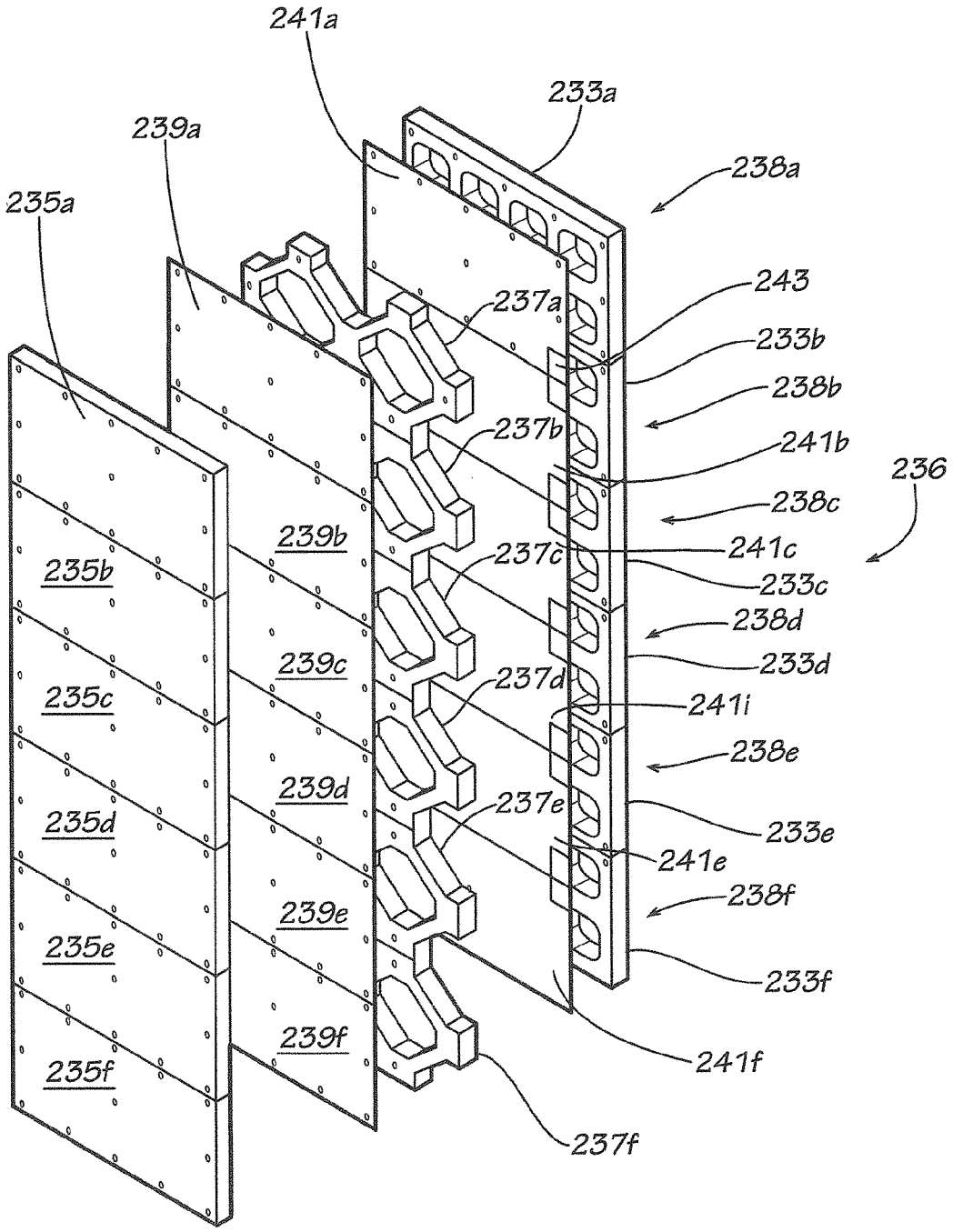

Referring now collectively to FIGS. 2*h*-2*k*, examples of block structures 230*a* and 230*b* that are formed by connecting various types of blocks are described. In one example (FIGS. 2*h*-*i*), components 232*a* and 232*b* are coupled together to form a block 231*a*. Other components are coupled together to form blocks 231*a*, 231*b*, 231*c*, and 231*f* (FIGS. 2*h*-*i*) and blocks 231*g*, 231*h*, and 231*i* (FIGS. 2*j*-*k*). As shown, connector plates 234 are used to secure blocks 231*a*, 231*b*, 231*c*, 231*d*, 231*e*, and 231*f* together (FIGS. 2*h*-*i*) and thereby form a wall structure. In addition, connector plates 236 are used to connect blocks 231*g*, 231*h*, and 231*i* together (FIGS. 2*j*-*k*) to form a beam structure. In both cases, a truss structure is formed. The plates 234 and 236 strengthen the resulting structures. As with the other block components described herein, any of the block components can be constructed of any suitable material.

Figure 21:
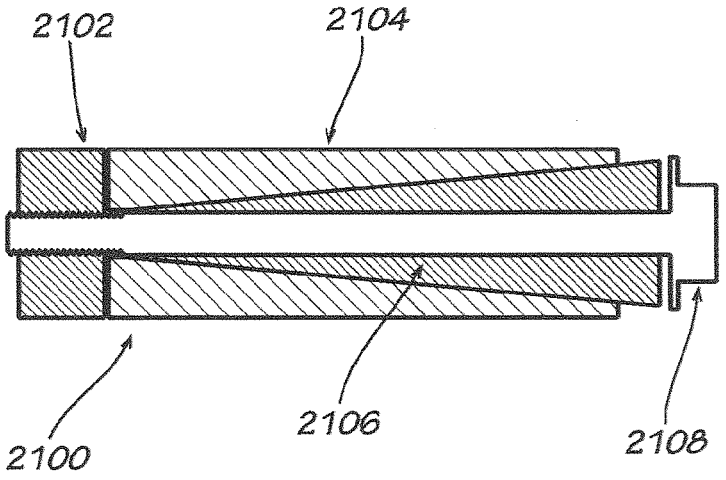
FIG. 21 is a diagram of an expansion bolt according to principles of the present invention.

Metal plates can be used to provide addition strength for any of the blocks or structures described herein. Referring now to FIG. 21, a wall structure 236 comprises a plurality of blocks 238*a*, 238*b*, 238*c*, 238*d*, 238*d*, and 238*f*. The blocks respectively each include an inner component 235*a, b, c, d, e*, or *f*, an outer component 233*a, b, c, d, e*, or *f*, a first metal plate 239*a, b, c, d, e*, or *f*, a second metal plate 241*a, b, c, d, e*, or *f*, and a seismic component 237*a, b, c, d, e*, or *f*. Additional components may be substituted for these components. The first metal plates 239*a, b, c, d, e*, or *f* are held together by connector plates (not shown). The second metal plates 241*a, b, c, d, e*, or *f* are held together by connector plates 243. The metal plates 239*a, b, c, d, e*, or *f* and 233*a, b, c, d, e*, or *f* provide addition structural strength and support for the wall structure 236.

Figure 3:
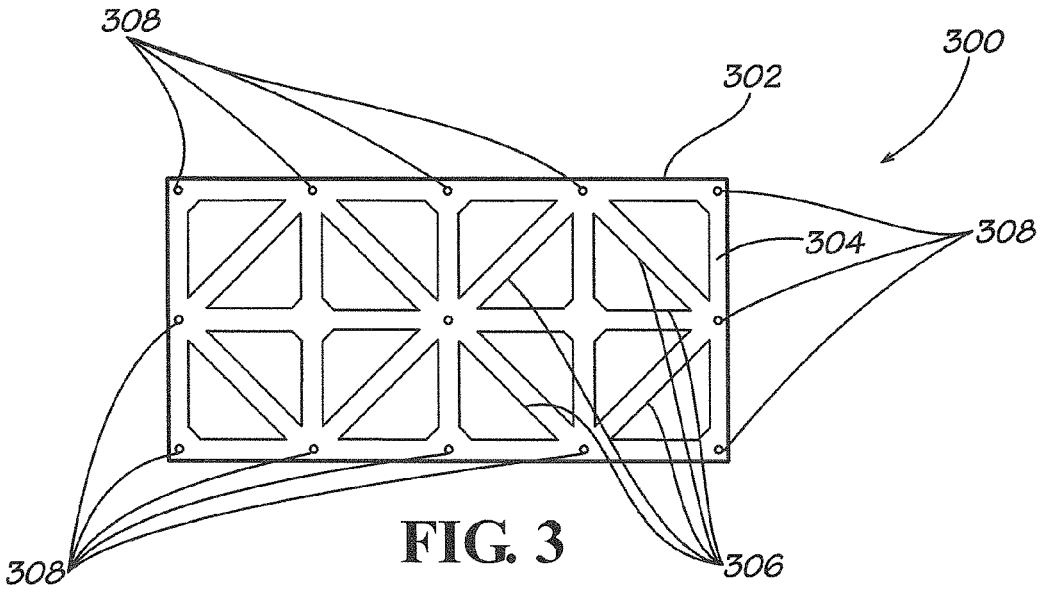
FIG. 3 is an example of a truss structure of a block component according to the present invention.

Referring now to FIG. 3, one example of the internal structure of a component of a block is described. The block component 300 comprises a truss structure that includes a plurality of members arranged in a triangulated pattern. More specifically, the block component 300 includes horizontal members 302, vertical members 304, and diagonal members 306. It will be appreciated that the members may be aligned in any number of angles, configurations, or patterns besides the pattern shown in FIG. 3.

If vertical load and seismic relief components are used, the vertical load component (i.e., outer and inner panel) and the lateral bracing component (seismic panel) may be assembled together to create a truss. The two components can be fabricated as one panel component. Advantageously, these separate components allow easier incorporation of the building system components.

As shown, the horizontal members 302, vertical members 304, and diagonal members 306 are formed together in one mold so that they form one piece. Alternatively, each of the horizontal members 302, vertical members 304, and diagonal members 306 may be formed separately and attached together with some attachment mechanism (e.g., glue, screws, or pins). In still another, some of the horizontal members 302, vertical members 304, and diagonal members 306 may be formed separately and some formed together.

Each of the horizontal members 302, vertical members 304, and diagonal members 306 may be formed from materials such as such as cement (e.g., Portland cement), woods, woven wire, plastics, metals, CAC or any combination of these or other materials. Polymers, reducers, and specialized aggregates can be used as ingredients of these materials. These materials provide for rigidity and compressive strength. The horizontal members 302, vertical members 304, and diagonal members 306 may be formed about reinforcing wire, rope, or fiber for increased strength and stability. Pin connectors 308 may be used to connect the component to other components and form a block.

Figure 4:
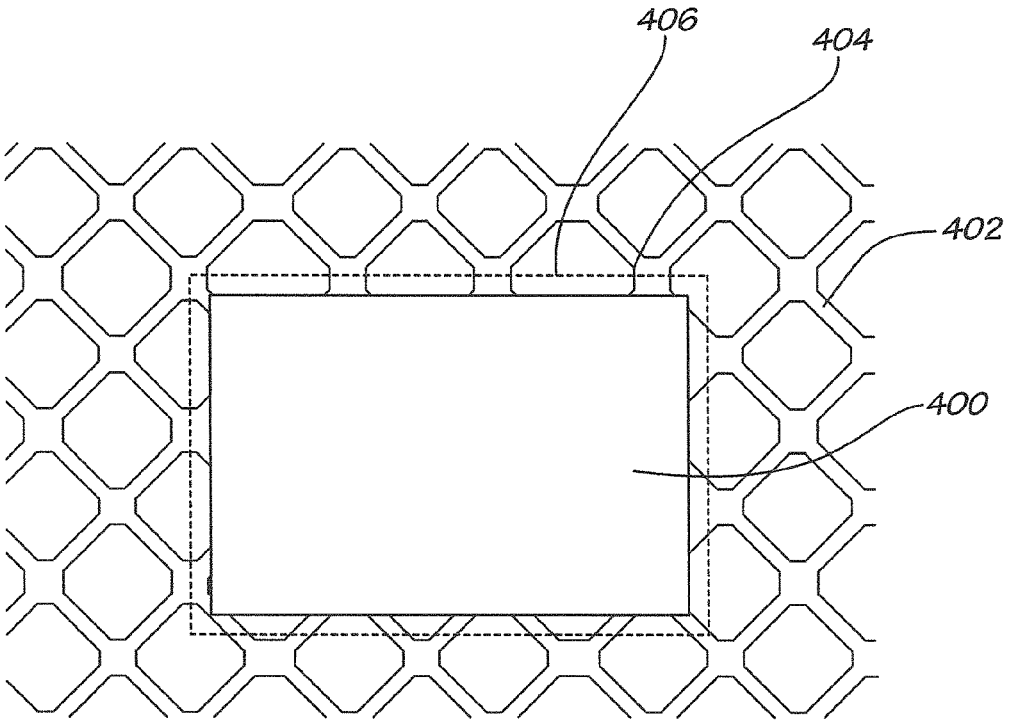
FIG. 4 is an example of a wall assembly having an opening according to the present invention.

Referring now to FIG. 4, one example of providing an opening 400 in a building panel 402 (e.g., a wall) is described. When the individual blocks are assembled together, the wall assembly forms one structural element. Advantageously, this approach allows cut-outs to be made without compromising structural integrity. The opening 400 is provided through the honeycomb truss structure of the building panel 402. The building panel 402 comprises one or more building blocks with each of the blocks having a component with a honeycomb structure. For example, the blocks may include inner and outer components having a solid structure and a seismic restraint component having a honeycomb structure. Alternatively, any of the components may have solid or semi-solid structures.

As shown in FIG. 4, the opening 400 has an edge 404 that is positioned so as to be within a structural integrity boundary 406. If the opening 400 were positioned beyond the structural integrity boundary 406, it is possible that the resulting structure would be unstable. Consequently, because of its positioning, the opening 400 does not detract from the structural integrity of the building panel 402.

Figure 5A:
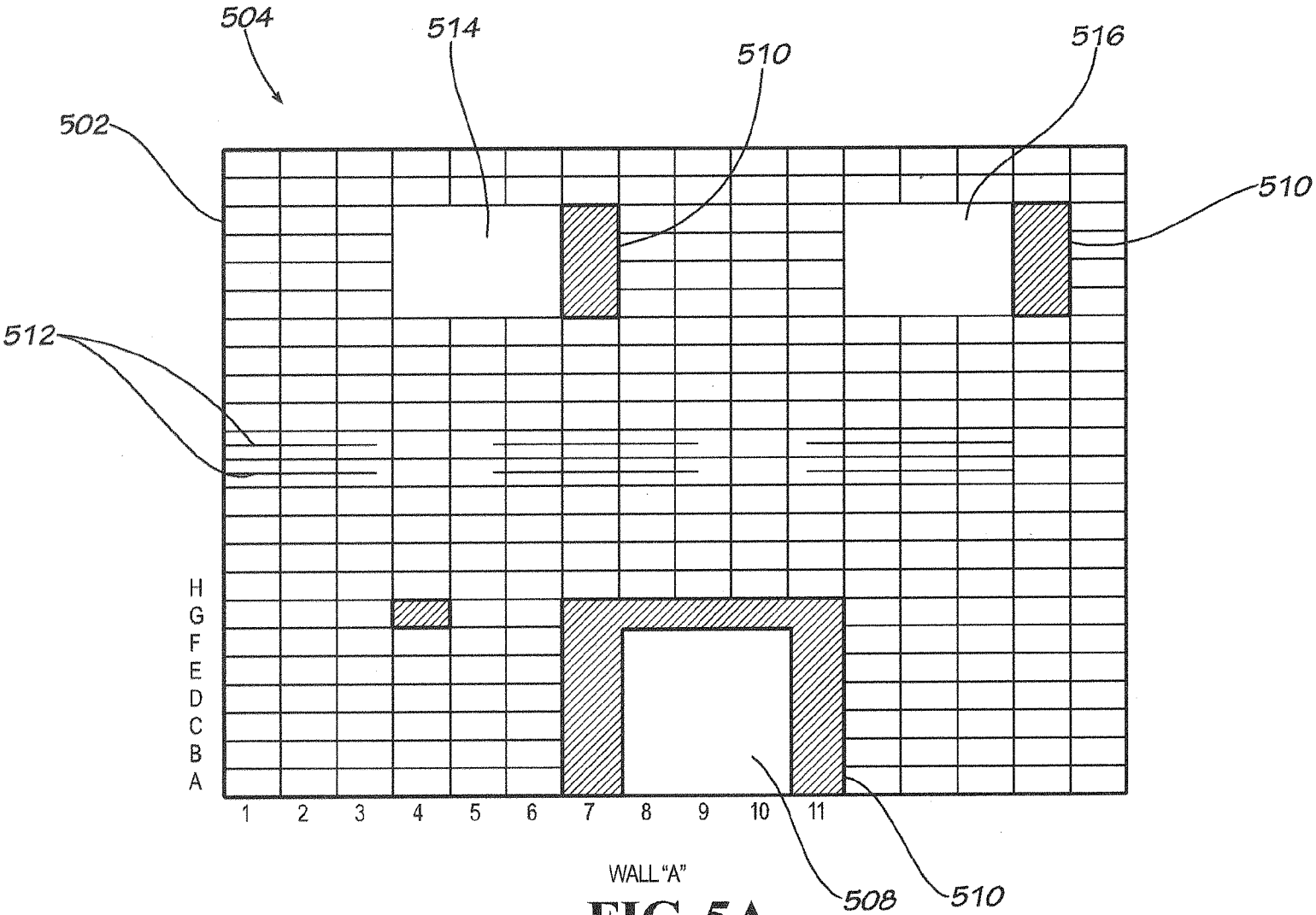
FIGS. 5*a-c* is a diagram of a wall structure comprising a plurality of blocks according to the present invention.

Referring now to FIG. 5*a*, one example of assembling blocks 504 into a building panel 502 (e.g., a wall) of a building is described. The building panel 502 includes a plurality of the blocks 504. Using automated processes and computer software, the block components can be assembled into blocks, labeled for assembly, and palletized for shipment. A builder receives the blocks and uses the labels to assemble the blocks 504 into a wall as shown in FIG. 5*a*.

The labels may utilize any kind of numbering scheme to indicate how a particular block is to be positioned relative to the other blocks to be assembled. For instance, one approach uses a reference system whereby one element represents a row and another element represents a column for placement of each of the blocks 504. In this example, a value of A-1 indicates a particular block should be placed in the first row and first column, and a block labeled C-3 indicates this particular block should be placed in the third row, third column. Other labeling schemes may also be used to facilitate placement and assembly of the blocks.

An opening 508 is configured to be a door. Floor lines 512 occur between the first and second floors of the structure. The blocks between the floor lines 512 may be configured in specific ways to engage or couple to the floor. Openings 514 are 516 are configured to be windows. Highlighted blocks 510 to indicate that the blocks require modification (e.g., painting, sanding, or the addition of other elements). The highlighted areas indicate areas of special attention. This may include custom block fabrication, standard block modification or additional panel components. The openings 508, 514, and 516 are positioned and are of suitable dimensions so as to not detract from the structural integrity of the building panel 502.

Figure 5B:
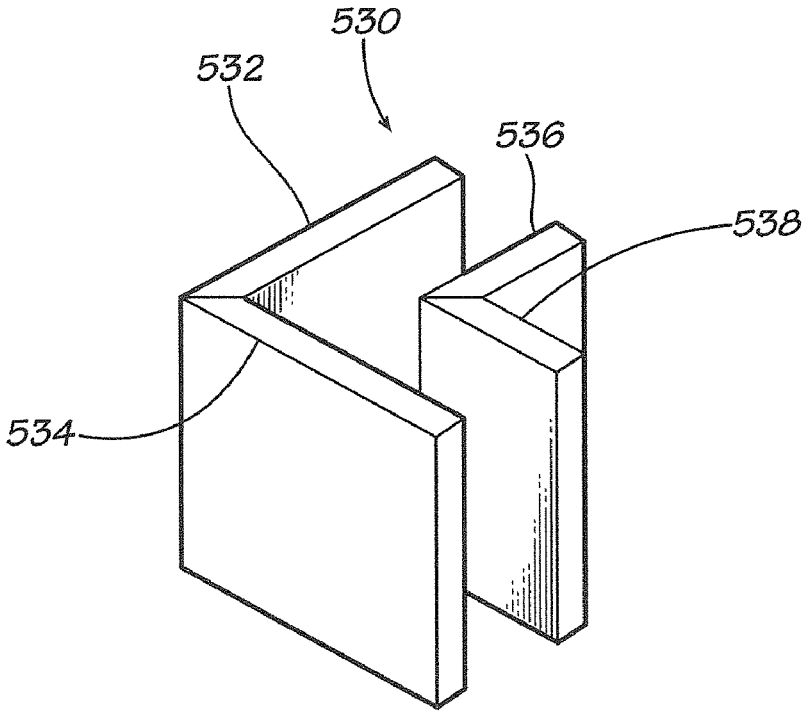
Figure 5C:
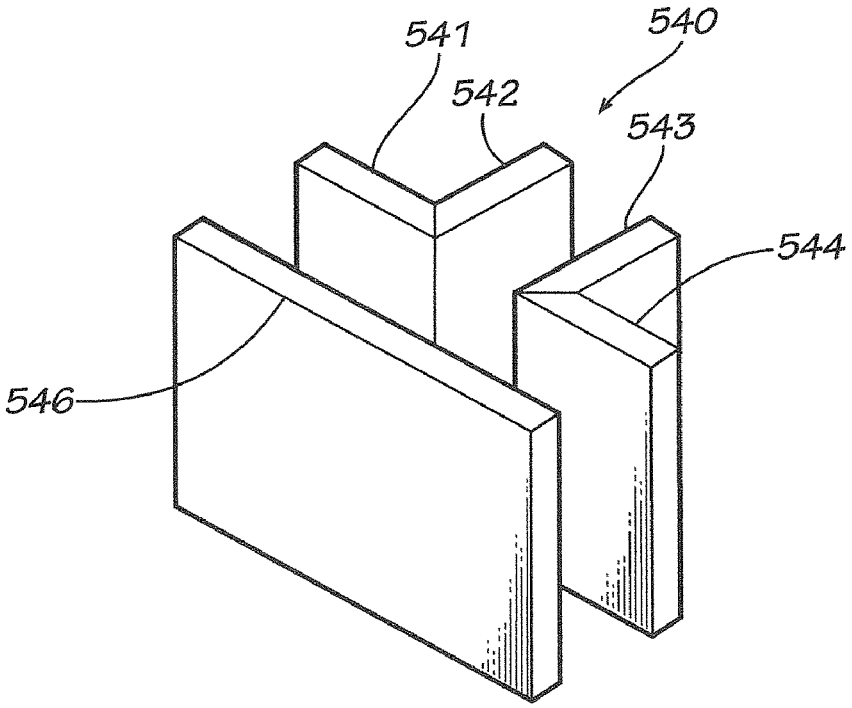

Referring now to FIGS. 5*b*-5*c*, examples of employing the blocks in various wall structures 530 and 540 are described. For example, the wall structure 530 can be created by forming walls 532 and 534 and 536 and 538 respectively. Prefabricated corners and intersections complying with design requirements for wall assemblies can be formed. Similarly, the walls 541, 542 and 543, 544 and 546 can be configured as shown using the blocks described herein. The walls 532, 534, 536, 538, 541, 542, 543, 544, and 546 can be constructed using any of the blocks (with any of the components) described herein.

Figure 6:
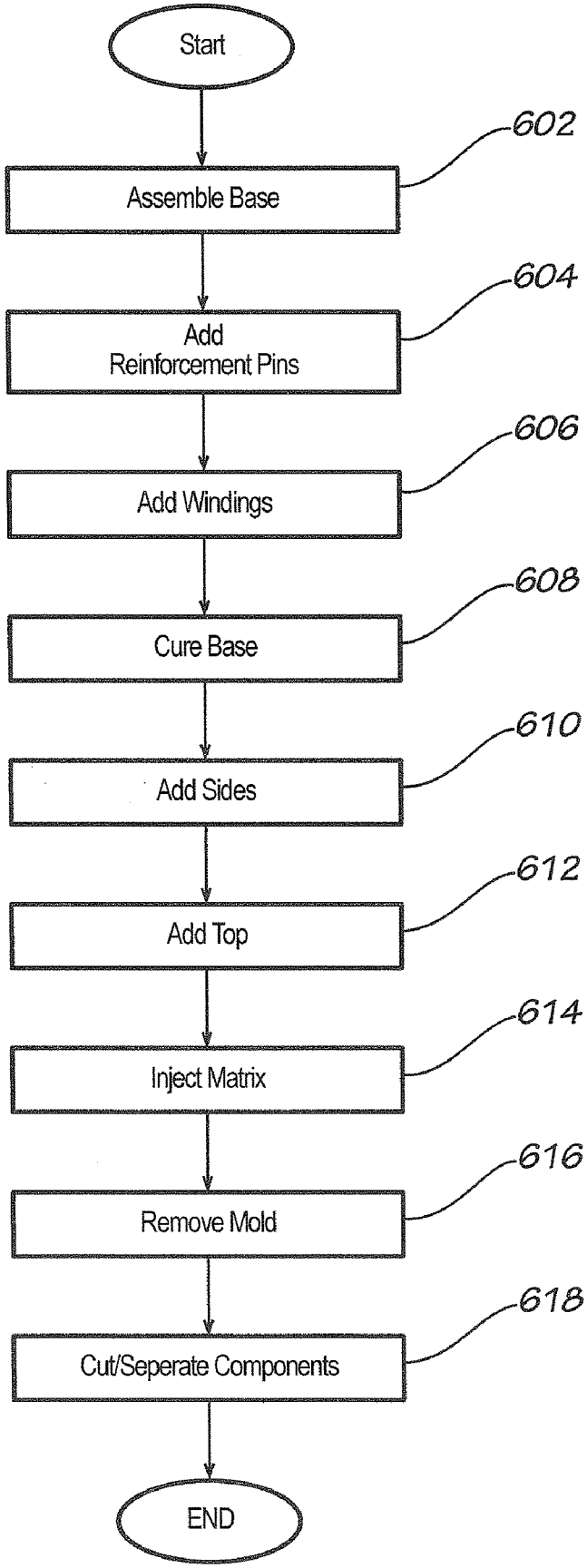
FIG. 6 is a flowchart of the manufacturing steps for a component to be used in a block according to the present invention.

Referring now to FIG. 6, one example of a manufacturing process that is used to construct components of a block is described. At step 602, a base mold is assembled and placed on the belt. Specifically, metal base plates are aligned on a conveyor belt system. The conveyor belt may be angled downward, for example, at a 30 degree angle.

At step 604, reinforcement connector pins are added to the mold. More specifically, these pins are attached to the metal base plates.

At step 606, reinforcement windings are added. Specifically, as the metal base plates move along the conveyor, a continuous reinforcement (e.g., carbon fiber, wire rope, cable) is attached to the reinforcement connection pins. The number and/or size of the reinforcement windings vary depending upon tensile strength requirements of the block. The winding is applied to the mold in a continuous operation.

If a fiber reinforcement is used for the winding, the bonding matrix (e.g., the material applied around the winding in the mold channel to provide the structure of the component) may be thermoset or thermoplastic. In this case, the speed of the conveyor is adjusted to allow the base a sufficient amount of time to cool. The length of the conveyor may be adjusted based upon the length of the setting or cooling. In some preferred approaches, a bonding matrix that is resistant to heat and alkali is used. Heat curing can be used to cure the winding, for example, when the winding is a fiber reinforcement and the material used for the component is resin.

At step 608, preheating of the base plate occurs. At this step, the base plate travels through an oven and the oven heats the mold sections including the base plate. The mold sections may be heated by convective heating, conductive heating, or a combination of both convective and conductive heating. Other techniques such as microwave heating and ultrasound may also be used. Preferably, the heating is evenly applied to the plate so as to maintain dimensional accuracy and prevent warping of the mold. Operating temperatures may be as high as possible without causing the bonding matrix or material to boil prior to setting. For example, the temperature may be 120-300 degrees Fahrenheit.

At step 610, as the preheated base mold moves along the conveyor belt, preheated mold sides are placed onto the base mold. Tapered alignment pins may be used to accurately index the sides. At step 612, a flexible belt is applied and rolls along the top of the mold assembly to act as a mold top. The belt applies pressure on the mold sides and the applied pressure thereby locking the mold assembly into position.

At step 614, a matrix or material is poured or injected into the mold. In one example, cement is selected as the matrix and is dispensed at a matrix dispensing point that is positioned just ahead of the mold top. The dispensing point dispenses the matrix continuously, thereby filling the area of the completed mold assembly. Alternatively, the cement may be pressed into the mold. Advantageously, when cement is used as the bonding matrix, the method of hot mold casting described herein speeds the chemical reaction occurring in the cement causing the cement to set faster than would normally occur.

At step 616, when the cement matrix is sufficiently set for a de-mold time period, the mold top, sides, and base are removed and prepared for reuse. For example, the mold components may be cleaned, sprayed with a mold release, and preheated. At step 618, blocks are cut and palletized for delivery.

Figure 7:
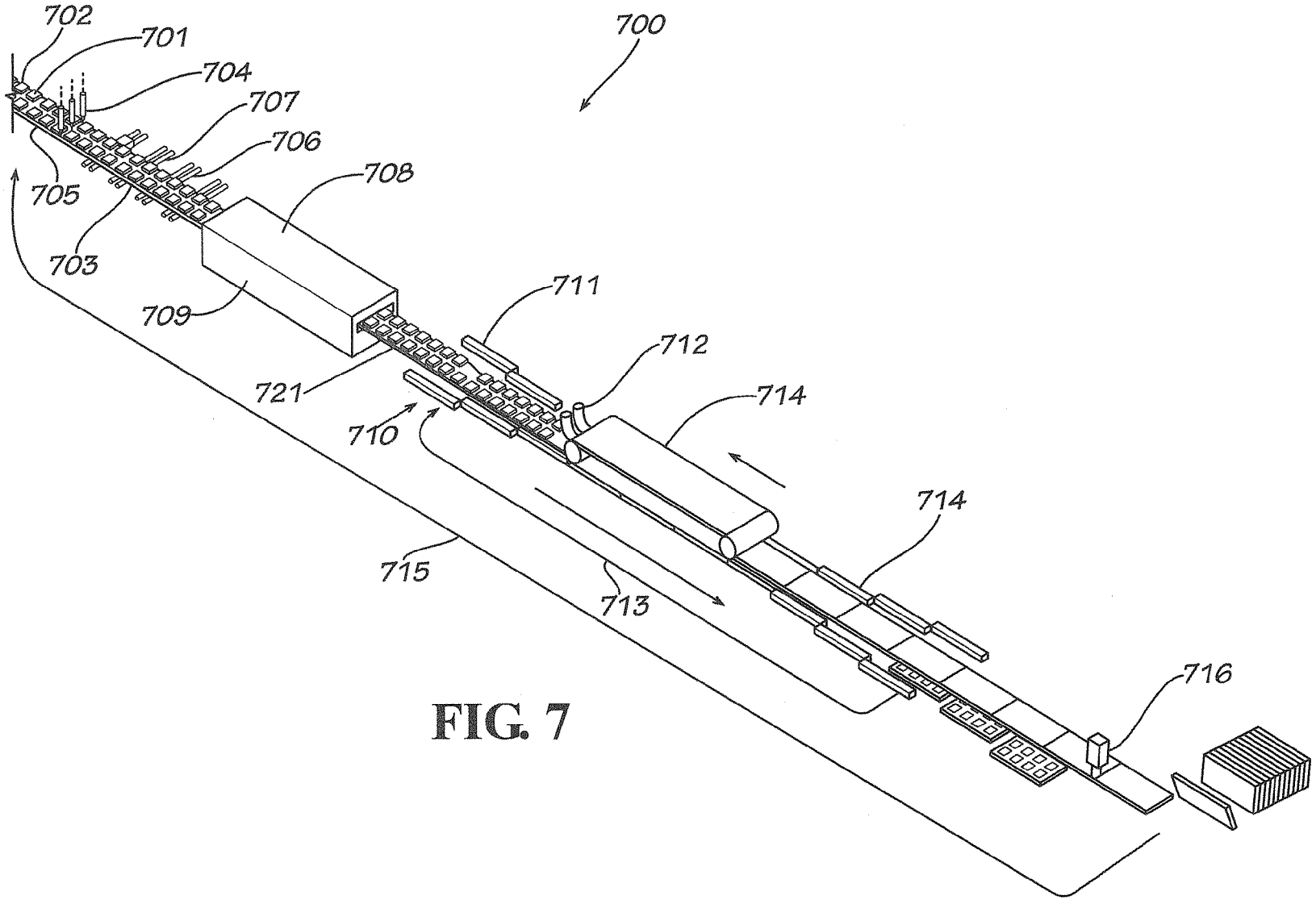
FIG. 7 is a perspective diagram of an assembly line implementing the manufacturing process of FIG. 6 according to the present invention.

Referring now to FIG. 7, an assembly line that is used to implement the method of FIG. 6 is described. In this example, the assembly line 700 is divided into different stations or areas where the various steps are performed. It will be appreciated that the number, type, and functions performed at any of the stations of this example may vary (as can the number and function of stations) according to the specific needs of the manufacturer or end-users.

At station 702, the base mold 701 is assembled and placed on the conveyor belt 703. Step 602 may be performed at the station 702 where metal base plates are aligned on a conveyor belt system. As mentioned, the conveyor belt 703 may be angled downward, for example, at a 30 degree angle.

At station 704, reinforcement connector pins 705 are added (step 604) and at station 706, the continuous reinforcement windings 707 are added (step 606). Specifically, as mentioned, these reinforcement connection pins 705 are attached to the base mold 701 and as the base mold 701 moves along the conveyor belt 703, continuous reinforcement windings 707 (e.g., carbon fiber, wire rope) are attached to the reinforcement connection pins 705.

At station 708, heating of the base plate takes place as mentioned at step 608. An oven 709 may be used for this purpose.

At station 710, mold sides 711 are attached (step 610) to the base mold 701. At station 712, cement matrix is poured (steps 612 and 614). At station 714, a mold top (e.g., formed by a surface of a top conveyor belt 721) is applied and the mold sides 711 and base 701 are removed (step 616). The mold sides 711 may be returned to be used by utilizing a path 713 and the base can be returned for reuse via a path 715. At station 716, block components are cut (step 618) and stacked.

Figure 8:
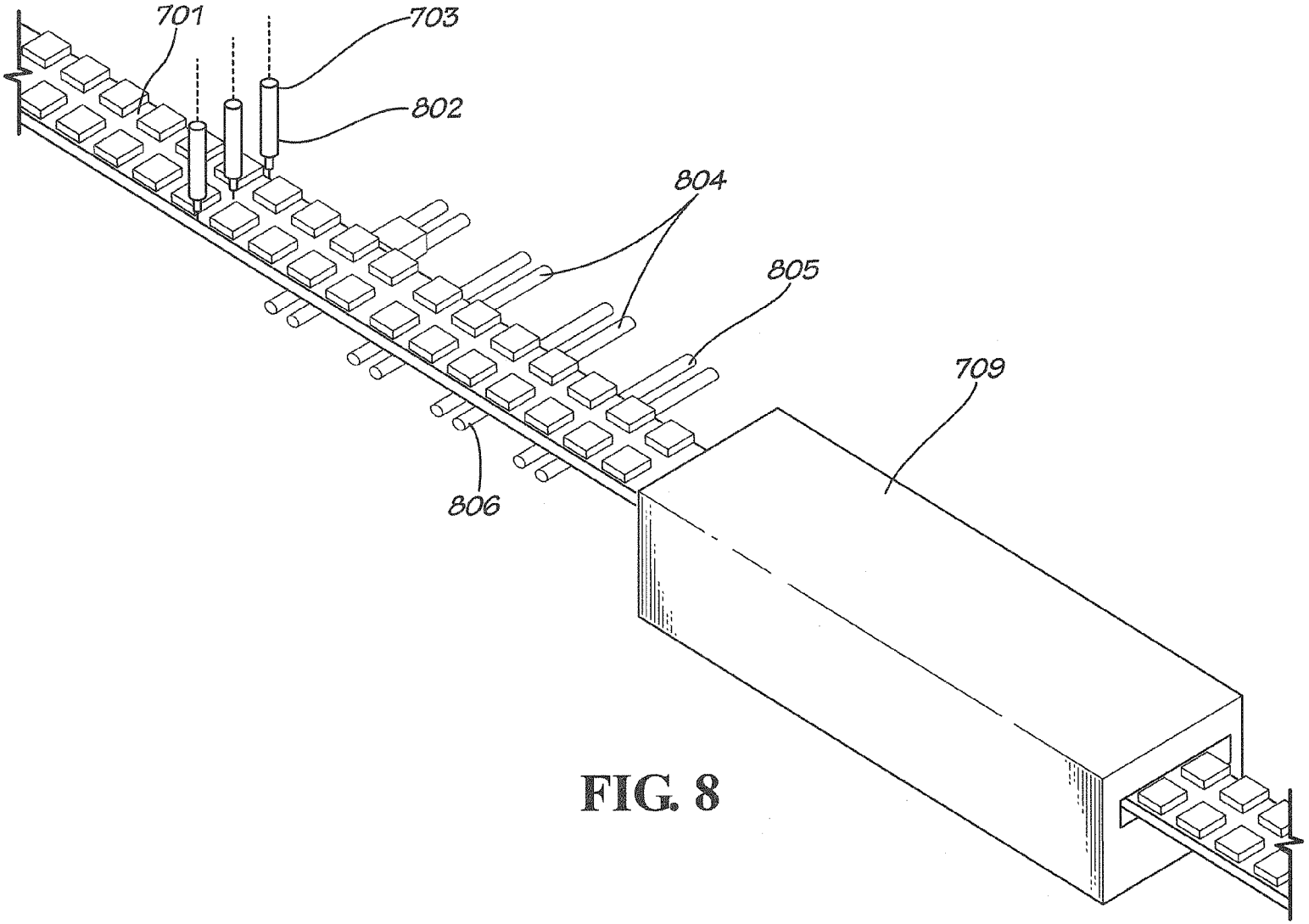
FIG. 8 is a perspective diagram showing details of the portions of the assembly line of FIG. 7 according to the present invention.

Referring now to FIG. 8, one example of how stations 702-708 are used is described. A reinforcement connector pin applicator 802 is used to apply the reinforcement connection pins 705 to the base mold 701 as the base mold 701 moves past the reinforcement connector pin applicator 802. Automated reinforcement machinery 804 is used to attach the continuous reinforcement windings 707 to the mold in the channels 806. Thereafter, the oven 709 is used to heat the base of the base mold 701.

Figure 9:
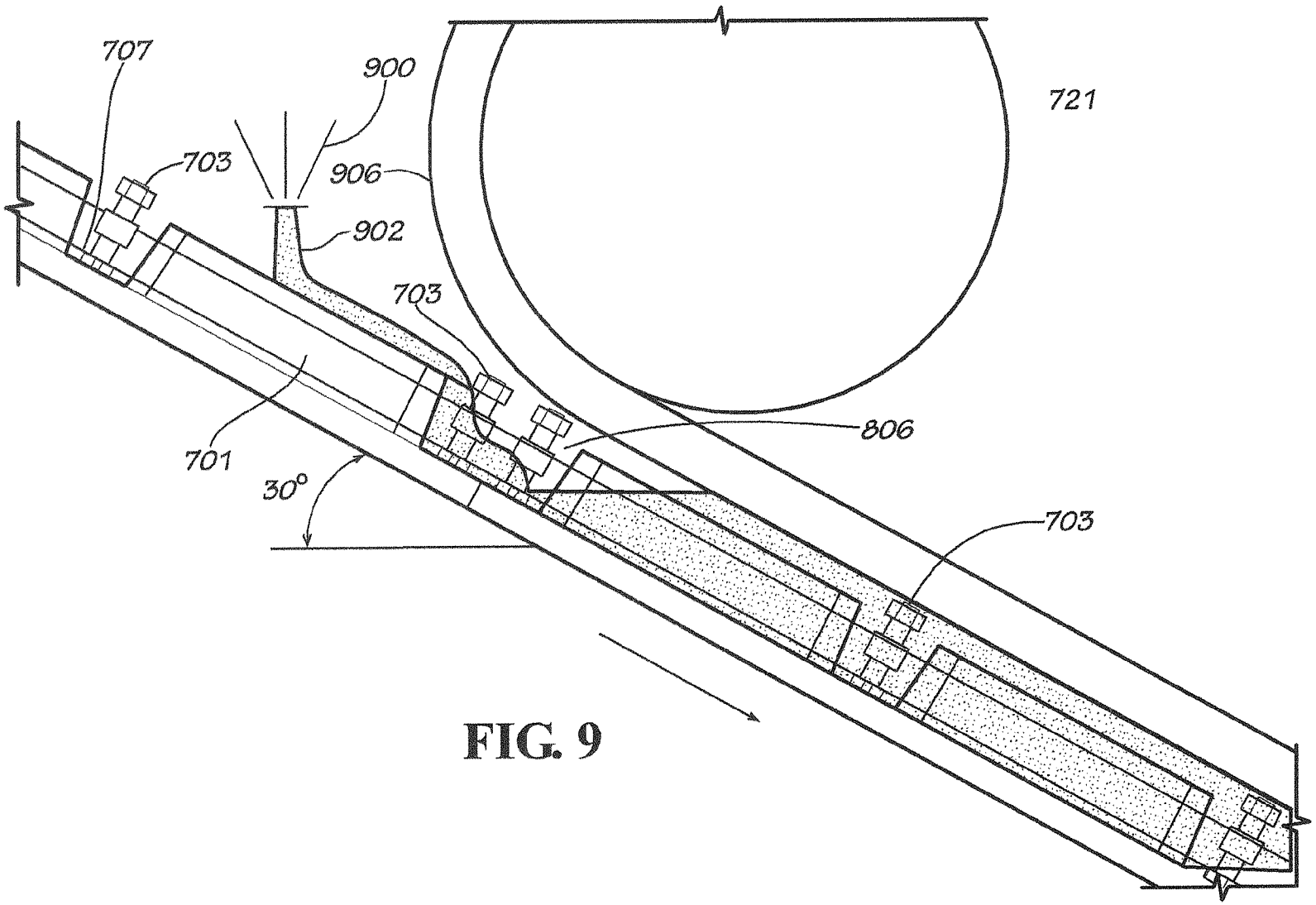
FIG. 9 is a perspective diagram showing other portions of the assembly line of FIG. 7 according to the present invention.

Referring now to FIG. 9, examples of injecting a material or matrix into the base mold 701 on the assembly line are described. A dispenser 900 injects a cement mixture 902 into channels of the base mold 701. The channels 806 include the continuous reinforcement windings 707, which are positioned therein. The mold is positioned on and moves with the conveyor belt 703. The base mold 701 is topped by a surface 906 of the conveyor 721 to hold the cement within the base mold 701. As mentioned, the conveyor belt 703 is positioned at a 30 degree angle to allow the cement or other matrix to flow. The cement is injected into the mold made of the base, the mold sides, and the mold top.

Figure 10A:
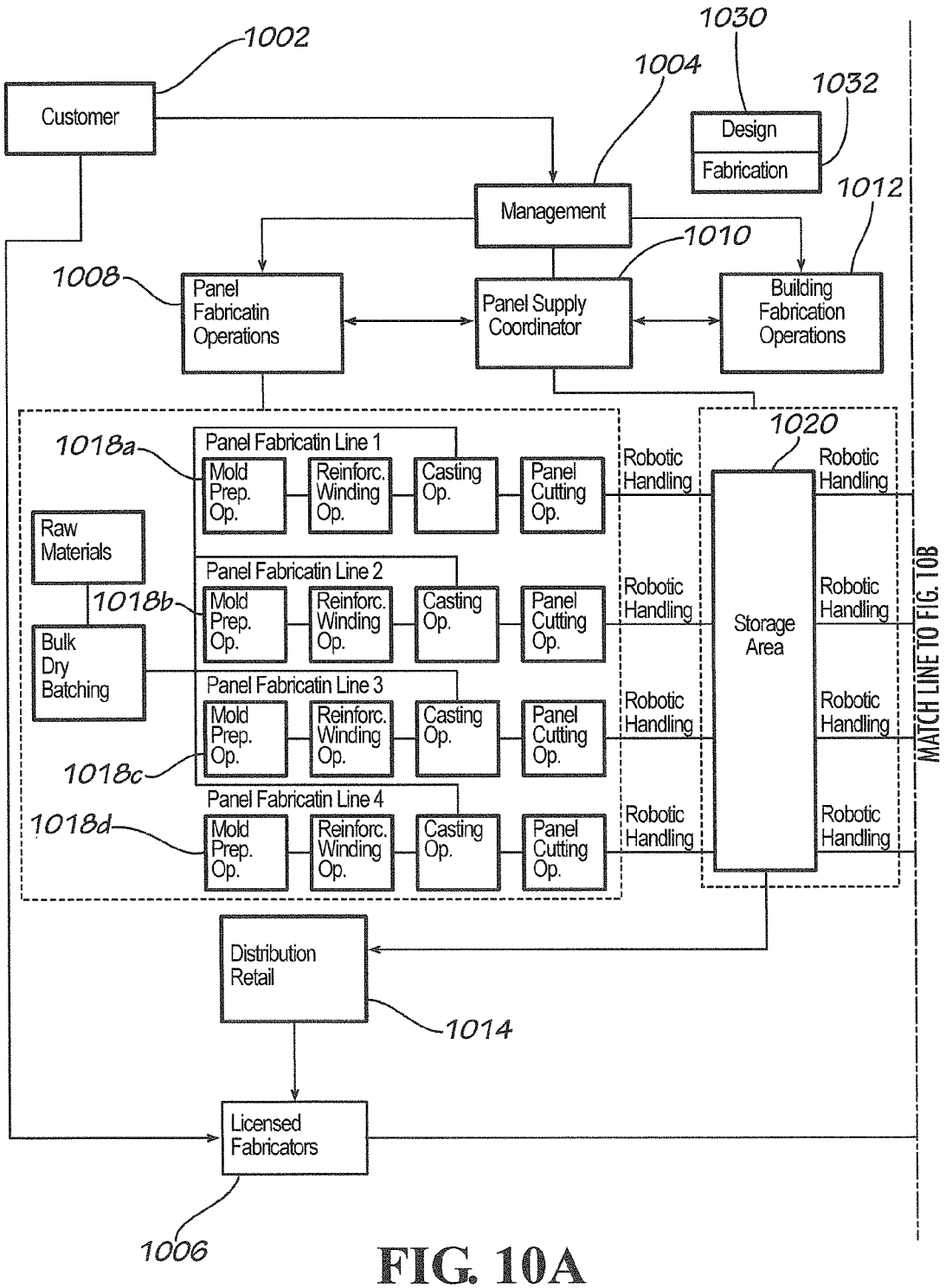
FIG. 10 is a flowchart showing an automated block assembly and distribution process according to the present invention.
Figure 10B:
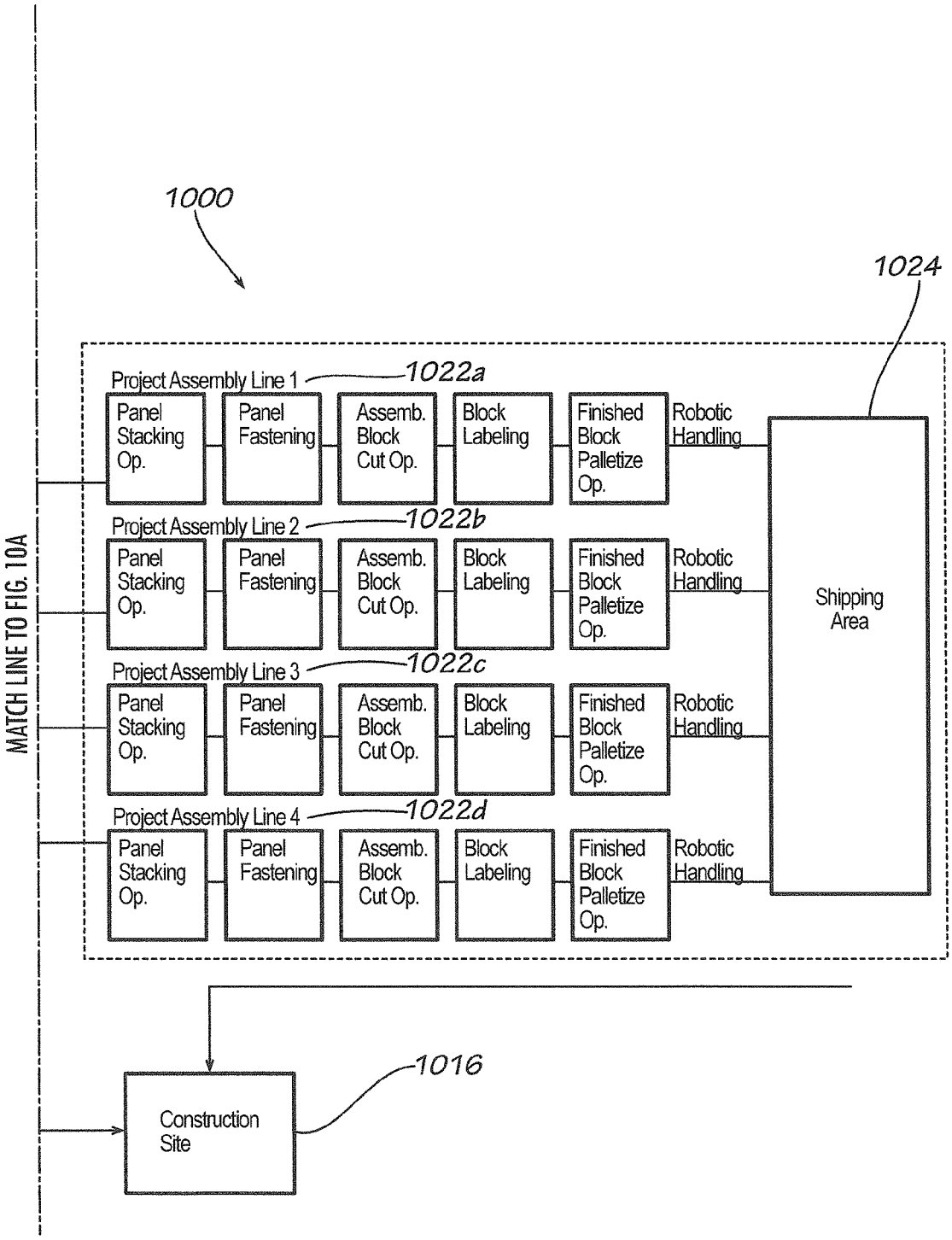

Referring now to FIG. 10, one example of an approach for automated block and building assembly at a factory 1000 is described. A customer 1002 sends instructions or an order to a management module 1004 or a licensed fabricator 1006. In the case of the instructions being sent to the licensed fabricator 1006, a separate, licensed manufacturer assembles the blocks from components made at the factory 1000.

When the customer 1002 requests or it is determined to route the request or order to the factory 1000, the management module 1004 determines whether the order is for a block having customized and un-built components. In this case, the order is routed to a block component fabrication operations module 1008, which constructs the block components for later assembly. Alternatively, the management module 1004 may determine that the block can be constructed from already manufactured components. In this case, the order is routed to a building fabrication operations module 1012, which is used to assemble the components into a block. In another example, the management module 1004 may determine a need to ship components to a distributor 1014 for sale or assembly. In this case, the order is routed to a block component supply coordinator 1010 that facilitates this process.

The computer software used in the system of FIG. 10 can be organized into a design module 1030 and a fabrication module 1032. The design module 1030 and fabrication module 1032 may be located at a central location or may be split apart into sub-modules and executed at different locations within the system. For instance, some sub-modules may be located at or near the assembly line and others of the sub-modules may be located at a central office away from the assembly lines.

More specifically, the design module 1030 can assist an architect or designer during the design and construction document phase of a project. The design module may be a stand-alone module used by a customer. The design module 1030 may assist with wall layouts, evaluate door and window placement, identify problems areas and propose alternatives, generates floor and roof panels, create parts and/or materials lists, perform cost analysis, and generate other details for the plans.

The fabrication module 1032 can be used to take the information created in the design module (e.g., the materials list) and converts the information into data that is used to fabricate the building blocks. The fabrication module 1032 may be integrated with the assembly line process control system to fully automate the block component production. For example, the fabrication module 1032 may determine quantities of each composite component, cut the components into particular shapes, mark the components, assemble the block components to create a wall panel, and palletize the components and prepare the components for shipment. The fabrication module 1032 can evaluate, route, and create machine code.

In one example of the operation of the system of FIG. 10, the customer 1002 sends an order for a particular block to the management module 1004. Alternatively, the order may be intended for or routed to a licensed fabricator 1006. The management module 1004 determines that some or all of the block components need to be manufactured and sends the order to the block component fabrication operations module 1008. The block component fabrication operations module 1008 instructs one of the assembly lines 1018*a*, 1018*b*, 1018*c*, and/or 1018*d* to fabricate the components of the blocks. After construction, the block components may be placed in a storage area 1020. The block component supply coordinator 1010 takes the blocks from the storage area 1020 and sends the components as appropriate to one or more project assembly lines 1022*a*, 1022*b*, 1022*c*, and 1022*d* for assembly into a completed block. The building fabrication operations module 1012 then facilitates the construction of the blocks by controlling the operation of the project assembly lines 1022*a*, 1022*b*, 1022*c*, and 1022*d*. The finished blocks can be sent to a shipping area 1024 and then to a construction site 1016 for assembly into a wall or other building structure.

More specifically, the block component fabrication lines 1018*a-d* are used to construct block components. For example, the lines may have mold preparation, reinforcement, casting, and cutting operations. From there, components are sent to a storage area 1020.

The project assembly lines 1022*a-d* are used to assemble the blocks from the components. These include component stacking, block assembly, labeling, and palletizing the finished block. At the end of these assembly lines 1022*a-d*, a complete block has been assembled. Robotic handling may be used to move the components from the assembly lines 1018*a-d* to the storage area 1020, from the storage area 1020 to the assembly lines 1022*a-d*, and from the assembly lines 1022*a-d* to the shipping area 1024.

Components in the storage area 1020 may be sent to retail or distributor 1014. From the retail/distributor 1014, the components may be sent to a licensed fabricator 1006 for assembly into blocks.

Referring now to FIGS. 11A-F, one example of a structure 1100 formed that is resistive to the effects of and to various forces is described. The structure 1100 includes a first frame 1102 and a second frame 1104. The first frame 1102 includes members 1106, 1108, 1110, 1112, and 1114. The second frame includes members 1116, 1118, 1120, and 1122. The frames 1102 and 1104 are coupled together using any type of coupling arrangement. The frames 1102 and 1104 may be part of blocks and the blocks coupled together. The members 1106, 1108, 1110, 1112, 1114, 1116, 1118, 1120, and 1122 may be constructed from any suitable material such as concrete, plastic, and steel. Other examples of materials can also be used. These members may include an embedded tensile reinforcement member (e.g., wire) that is wound around connector pins (not shown) as described elsewhere herein.

Figure 11A:
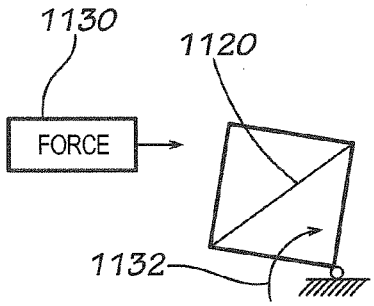
FIGS. 11A-F is a perspective diagram of a structure according to the present invention.
Figure 11B:
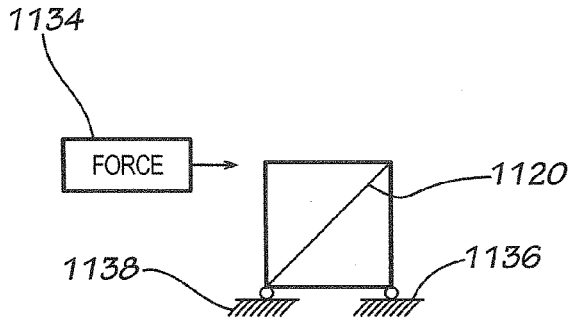
Figure 11C:
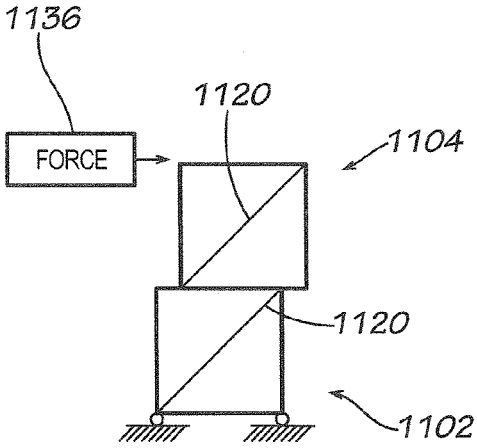
Figure 11D:
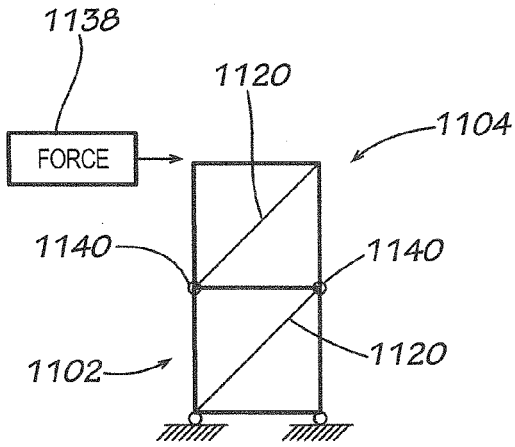

A polygon-shaped frame with four or more sides can deform when force is applied. The length of the sides does not change; however, the shape of the frame does change. If the polygon-shaped frame is triangulated (i.e., a member such as member 1120 as shown in FIG. 11A is used), the shape of the frame cannot deform. If a force 1130 is applied to this object with a pin connection on one corner, the reaction of the frame is to rotate in the direction indicated by the arrow labeled 1132. If a force 1134 is applied to a braced frame with pin connections at two points 1136 and 1138 as shown in FIG. 11B, the frame will resist the force 1134 until the material can no longer withstand compressive or tensile loads, or it will buckle. As shown in FIG. 11C, the second modular braced frame 1104 that is not connected to the first 1102 will simply slide as a result of a horizontal applied force 1136. As shown in FIG. 11D, a force 1138 that is applied to a second frame 1104 that is fixed to the first frame 1102 with a pin connection 1140 to the first frame 1102 will create a shear condition at the connection 1140.

Figure 11E:
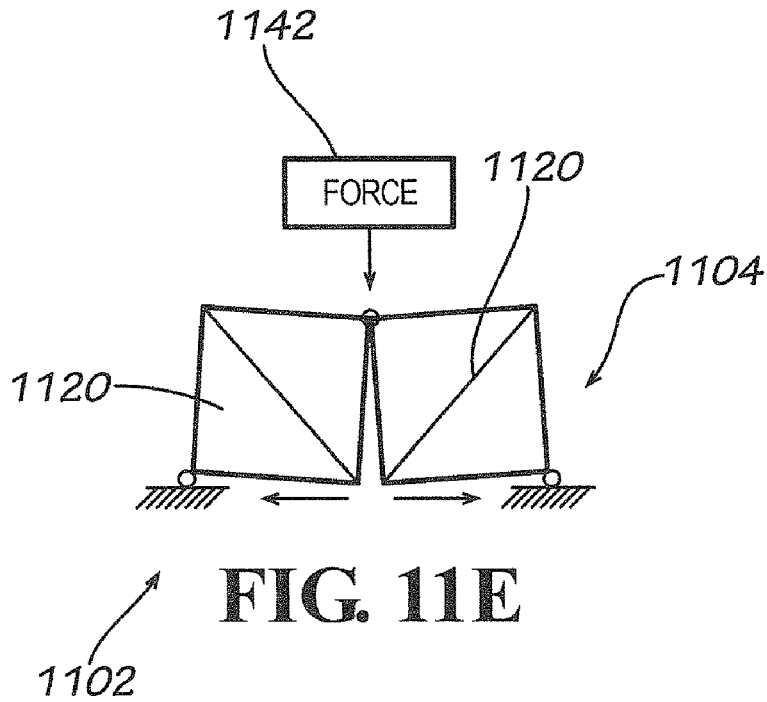
Figure 11F:
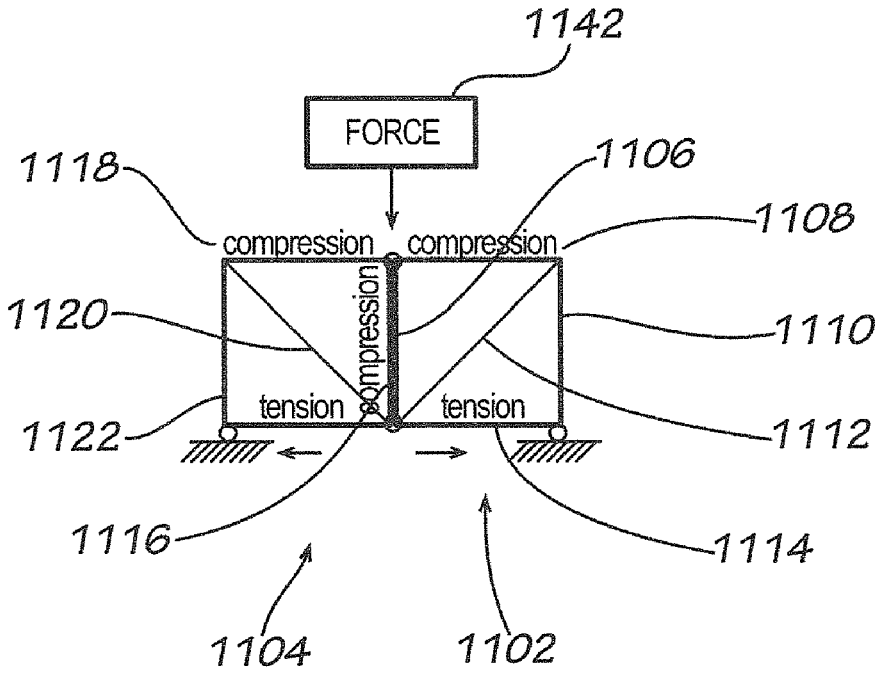

As shown in FIG. 11E, the modular braced frames 1102 and 1104 are connected side-by-side and supported on each end and a vertical force 1142 applied. As shown in FIG. 11F, a vertical force 1142 is applied where the two frames 1102 and 1104 are joined together. The components of each modular frame 1102 and 1104 are subjected to tension forces and a shear condition is created at the point of connection. It will be appreciated that although these examples illustrate braced frame design in two dimensions, they also apply in the three dimensions. The example of FIG. 11E resists the tension and compression forces shown in the figure thereby creating a more stable structure as compared to previous approaches.

Figure 12:
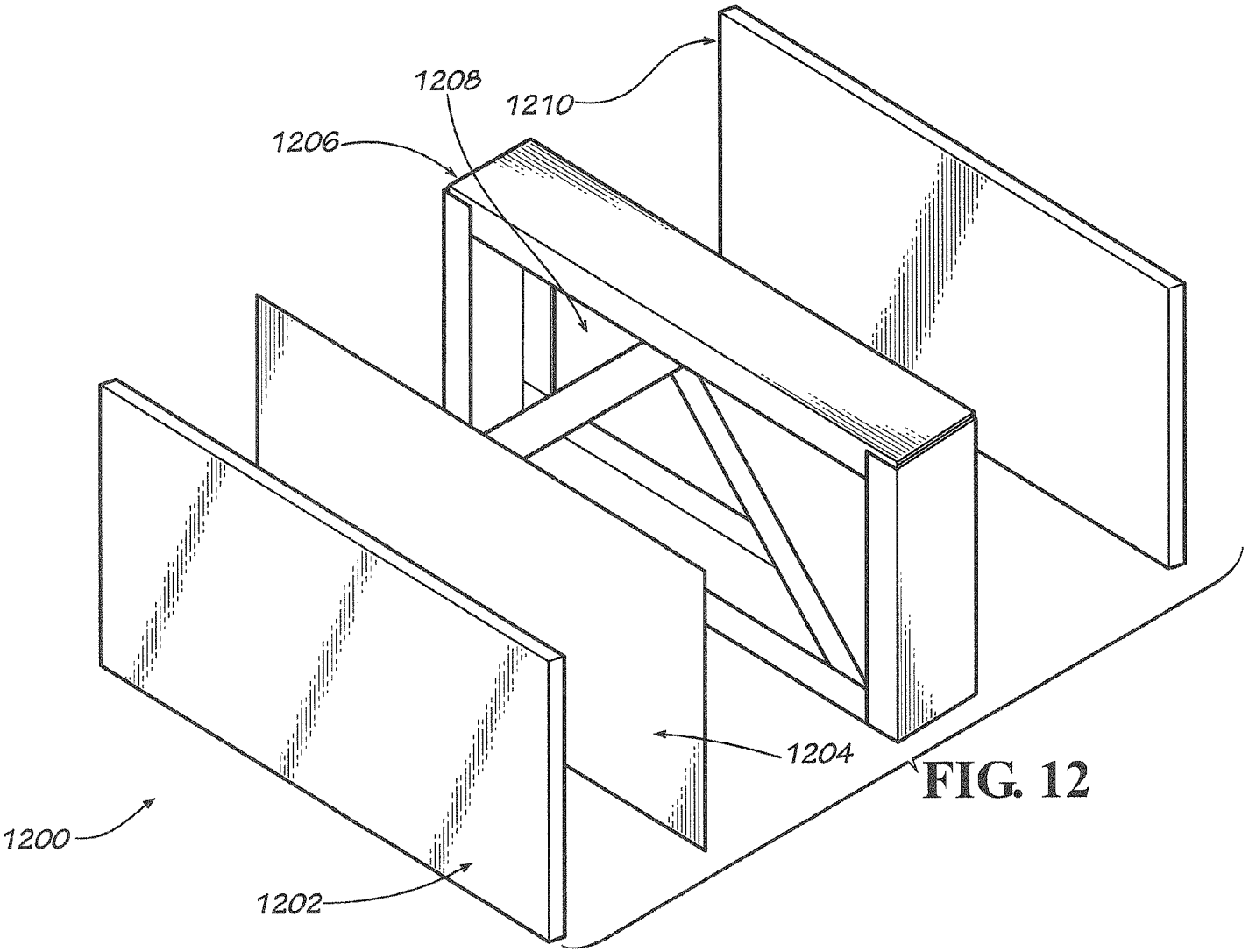
FIG. 12 is a perspective diagram of a structure according to the present invention.

Referring now to FIG. 12 another example of a structure 1200 (e.g., a block) is described. The structure 1200 includes a first protective layer 1202, a second protective layer 1204, a structural component 1206, insulation 1208, and a third protective layer 1210. It will be appreciated that the example elements of this figure illustrate one potential block configuration and that as described elsewhere in this application, other components assembled in other configurations may also be assembled.

The first protective layer 1202 may be an exterior cladding. For example, the layer 1202 may be a fiber cement board, wood, or masonry. Other examples of materials may also used in construction of this layer.

The second protective layer 1204 may be a weatherproofing layer. In this respect, it may be a vapor barrier, a waterproofing layer (i.e., constructed of some waterproof material), or constructed from Tyvec™. Other examples of materials are possible.

The structural component 1206 may be a planar truss (or space frame in other examples). In this respect, the structural component is a system of structural members arranged in a three-dimensional structural group. As described with respect to the examples of FIG. 11, the structural component 1206 supports/resists various types of forces when coupled with other structural components (i.e., in other blocks).

Insulation 1208 may be disposed within the structural component 1206. For example, various foam or other types of insulation may be used.

The third protective layer 1210 may be used for interior cladding. In this respect, it may be a gypsum wallboard or a fiber cement board. Other examples of materials may also be used for the third protective layer.

Figure 13:
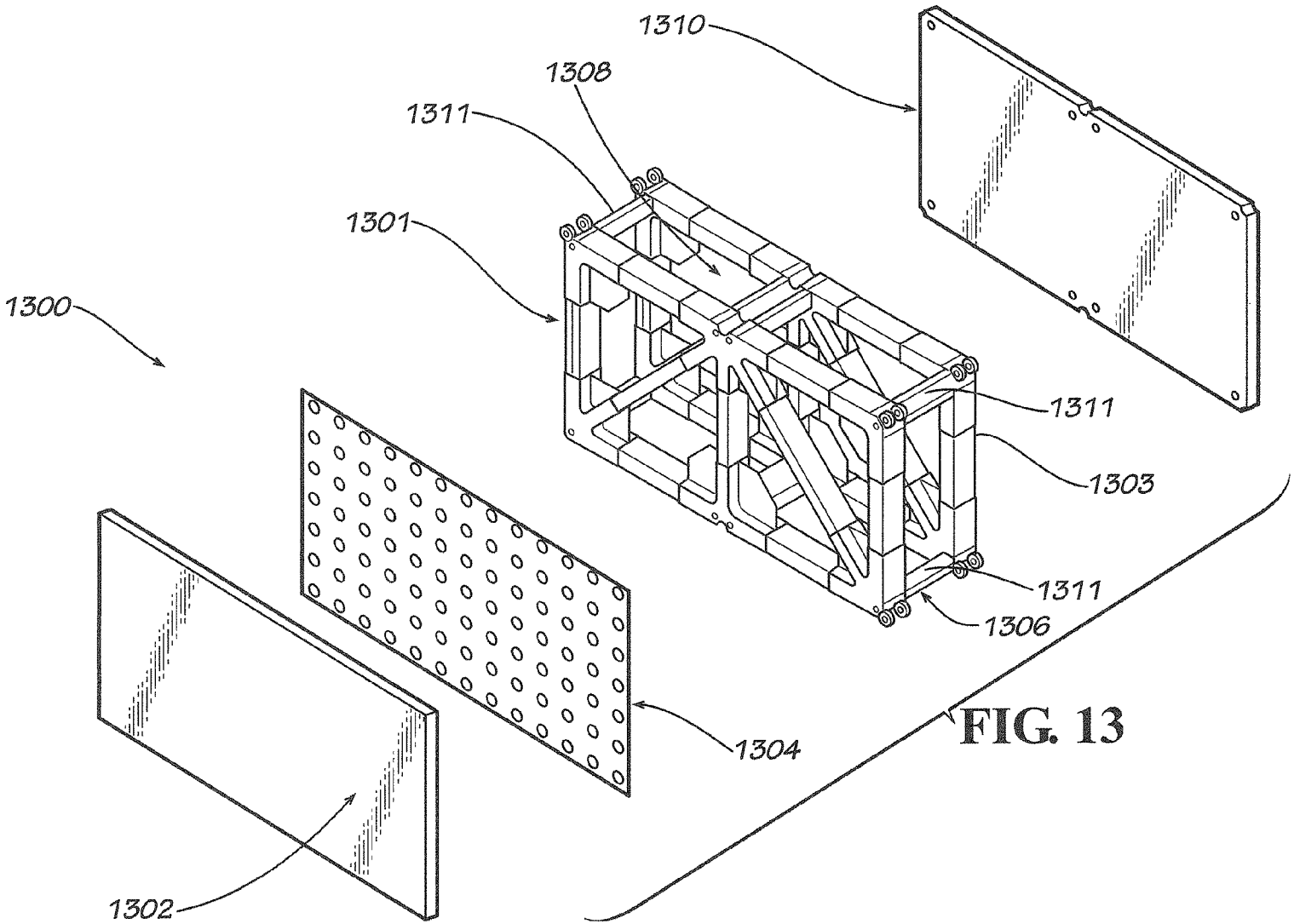
FIG. 13 is a perspective of another example of a structure according to principles of the present invention.

Referring now to FIG. 13 another example of a structure 1300 is described. The structure 1300 includes a first protective shell 1302, a second protective shell 1304, a structural component 1306, insulation 1308, and a third protective shell 1310. It will be appreciated that the example elements of this figure illustrate one potential block configuration and that as described elsewhere in this application, other components assembled in other configurations may also be assembled.

The first protective layer 1302 may be an exterior cladding. For example, the layer 1302 may be a fiber cement board, wood, or masonry. Other examples of materials may also used in construction of this layer.

The second protective layer 1304 may be a weatherproofing layer. In this respect, it may be a vapor barrier, a waterproofing layer (i.e., constructed of some waterproof material), or constructed from Tyvec™. Other examples of materials are possible.

The structural component 1300 is a combination of two sub-assemblies 1301 and 1303. Structural component 1301 integrates the structural load bearing component and seismic component to form a planer truss. Structural component 1303 integrates the structural load bearing component function and seismic component function to form a planer truss. The two sub-assemblies 1301 and 1303 are connected with struts 1311 to form a space frame. The structural component 1306 is arranged to resist loads in all directions.

Insulation 1308 may be disposed within the structural component 1306. For example, various foam or other types of insulation may be used.

The third protective layer 1310 may be used for interior cladding. In this respect, it may be a gypsum wallboard or a fiber cement board. Other examples of materials may also be used for the third protective layer.

Figure 14A:
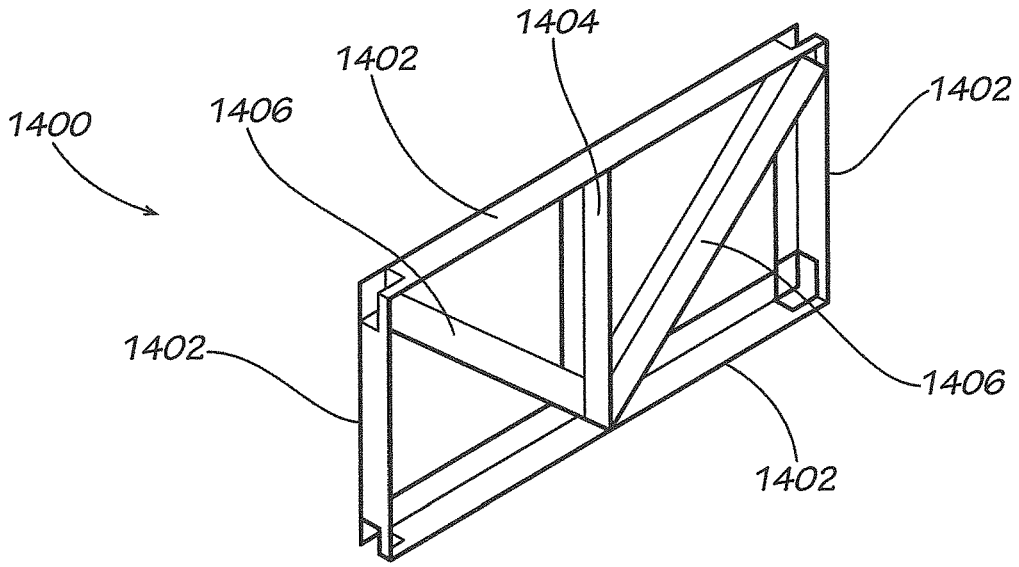
FIGS. 14A and 14B are perspective diagrams of structures according to the present invention.

Referring now to FIGS. 14A and B other example of structures are described. FIG. 14A shows a single planar truss 1400. The planar truss includes outer elements 1402, inner element 1404, and cross elements 1406. The elements 1402, 1404, and 1406 may be constructed of steel, cement, or some other suitable material. The planar truss 1400 provides both load bearing and seismic restraint functions.

Figure 14B:
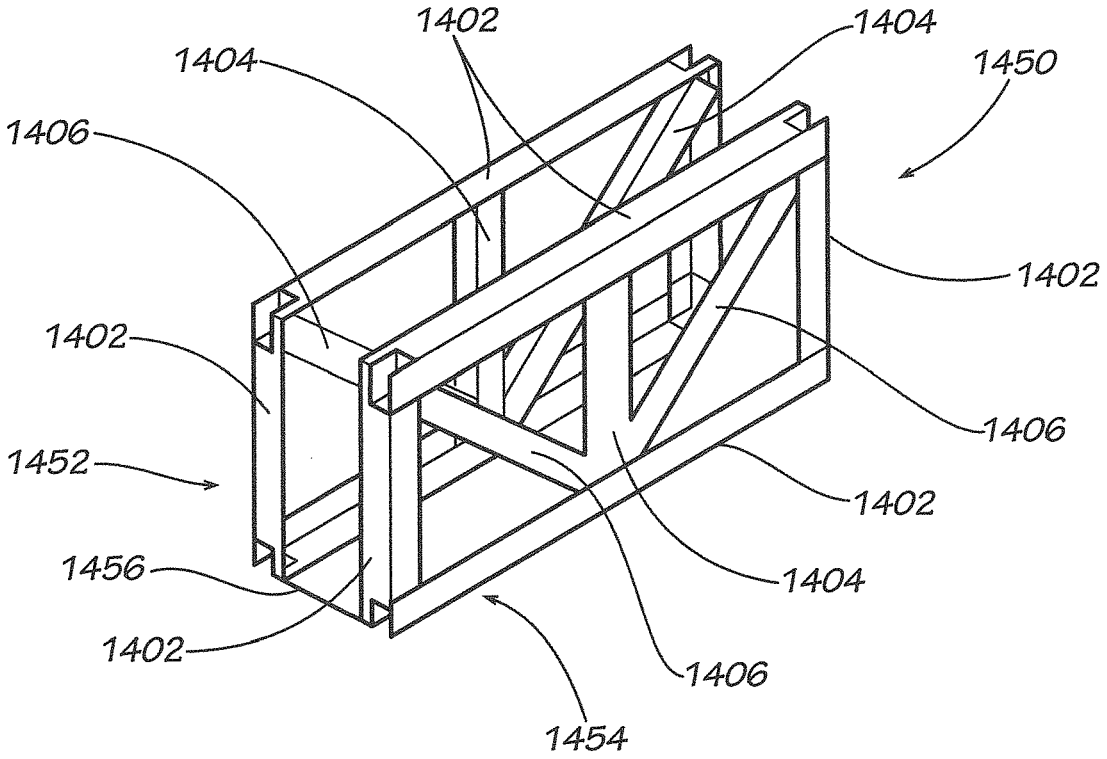

Modular truss section 1450 can be assembled as shown in FIG. 14B. The truss sections 1452 and 1454 may be coupled together by struts 1456. Truss sections 1452 and 1454 can be coupled together to create shear wall, roof, and floor sections.

In this regard, the individual sections 1452 and 1454 may be assembled together as shown and include other sections or layers (e.g., environmental protection layers, insulation, outer and inner cladding to name a few examples).

Figure 15:
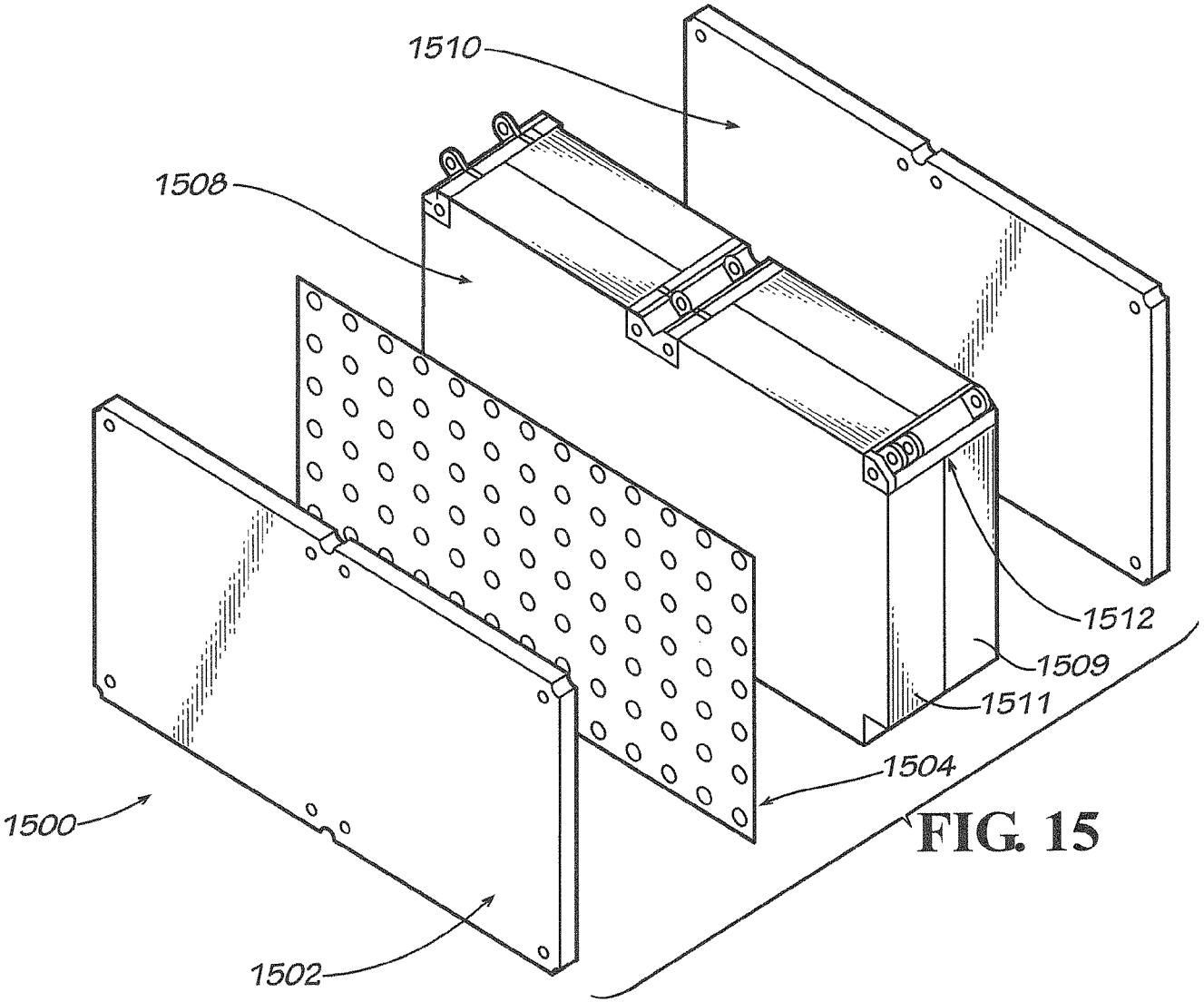
FIG. 15 is a perspective diagram of a structure according to the present invention.

Referring now to FIG. 15 another example of a structure 1500 is described. The structure 1500 includes a first protective layer 1502, a second protective layer 1504, insulation (utility component) 1508, a third protective layer 1510, and a connection bracket 1512. It will be appreciated that the example elements of this figure illustrate one potential block configuration and that as described elsewhere in this application, other components assembled in other configurations may also be assembled.

The first protective layer 1502 may be an exterior cladding. In this example, the layer 1502 is a fiber cement board with continuous triangulated reinforcing attached to connector pins in the panel. This reinforcing restrains the brackets from causing panel edge breakout under loading conditions. Other examples of materials may also used in construction of this layer.

The second protective layer 1504 may be a weatherproofing layer. In this respect, it may be a vapor barrier, a waterproofing layer (i.e., constructed of some waterproof material), or constructed from Tyvec™. Other examples of materials are possible.

Insulation 1508 includes two insulation blocks 1509 and 1511 that are coupled together with a connection bracket 1512. For example, various foam or other types of insulation may be used.

The third protective layer 1510 may be used for interior cladding. In this respect, it may be a gypsum wallboard or a fiber cement board. Other examples of materials may also be used for the third protective layer.

As used herein, "composite construction" exists when two different materials are bound together so strongly that they act together as a single unit from a structural point of view. When this occurs, it is called "composite action." One common example involves steel beams supporting concrete floor slabs. If the beam is not connected firmly to the slab, then the slab transfers all of its weight to the beam and the slab contributes nothing to the load carrying capability of the beam. However, if the slab is connected positively to the beam with studs, then a portion of the slab can be assumed to act compositely with the beam. In effect, this composite creates a larger and stronger beam than would be provided by the steel beam alone. The structural engineer may calculate a transformed section as one step in analyzing the load carry capability of the composite beam.

In some examples described herein, the protective layer (or shell), load bearing component, and utility component all act together structurally in composite action. For instance, the example of FIG. 15 includes a structure (e.g., a block) with a protective layer, insulation, and a second protective layer. By laminating these layers together, the layers act as a structural insulated panel. Bonding all of the layered components together creates an assembly that would act in composite action. Many of the other examples can also be structured to act in composite action.

Figure 16:
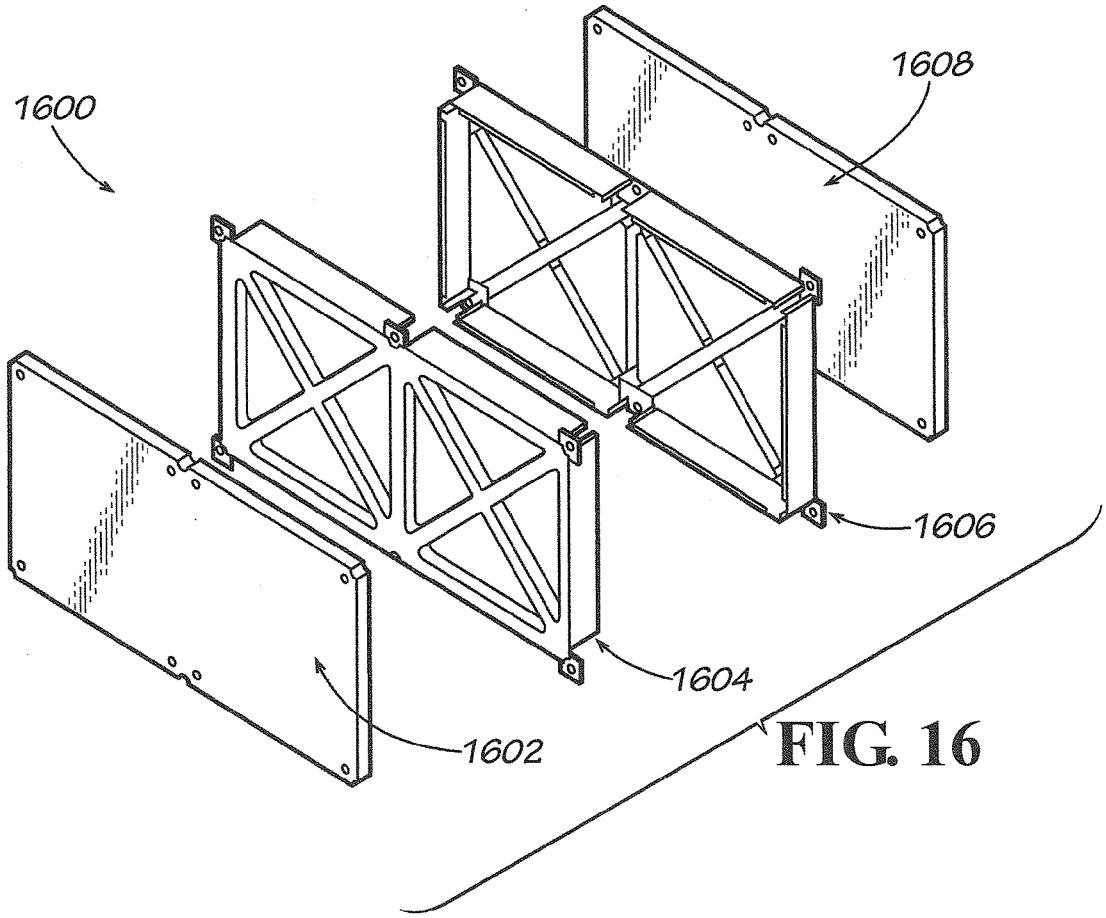
FIG. 16 is a perspective diagram of a structure according to the present invention.

Referring now to FIG. 16 another example of a structure 1600 is described. The structure 1600 includes a first protective layer 1602, a first structural component 1604, a second structural component 1606, and a second protective layer 1608. The components may be bolted or otherwise secured together using bolts or any other type of connecting arrangement. It will be appreciated that the example elements of this figure illustrate one potential block configuration and that as described elsewhere in this application, other components assembled in other configurations may also be assembled.

The first protective layer 1602 may be an exterior cladding. For example, the layer 1602 may be a fiber cement board, wood, or masonry. Other examples of materials may also used in construction of this layer.

The first and second structural components 1604 and 1606 are load bearing and seismic relief components. In this regard, they may be sheet metal panels that are bolted or otherwise secured together.

The second protective layer 1608 may be used for interior cladding. In this respect, it may be a gypsum wallboard or a fiber cement board. Other examples of materials may also be used for the third protective layer.

Figure 17:
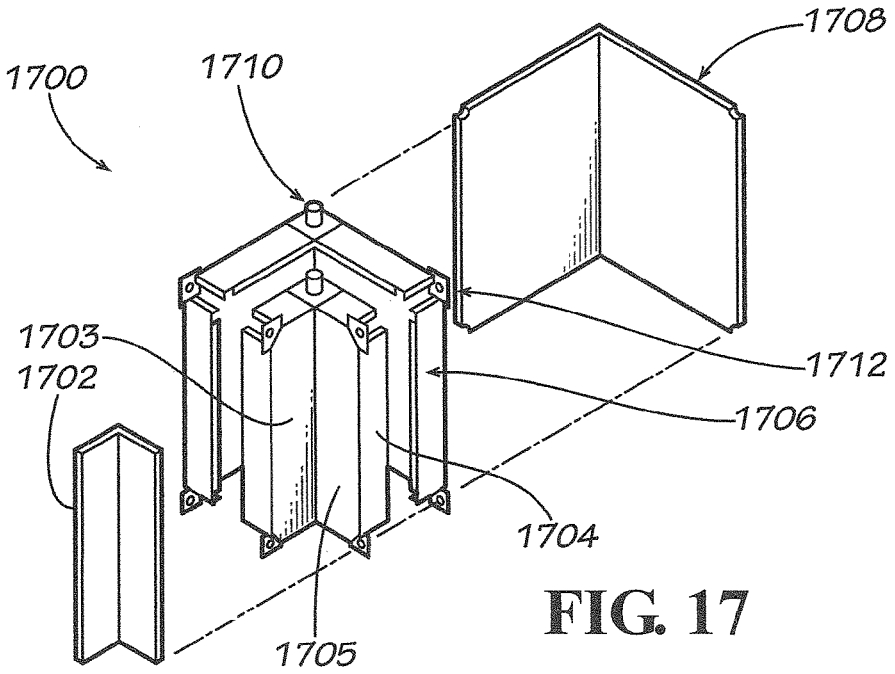
FIG. 17 is a perspective diagram of a structure according to the present invention.

Referring now to FIG. 17 another example of a structure 1700 is described. The structure 1700 includes a first protective layer 1702, a first structural component 1704, a second structural component 1706, and a second protective layer 1708. The components may be bolted or otherwise secured together using bolts 1710 and expansion bolts 1712 or any other type of connecting arrangement. It will be appreciated that the example elements of this figure illustrate one potential block configuration and that as described elsewhere in this application, other components assembled in other configurations may also be assembled.

The first protective layer 1702 may be an exterior cladding. For example, the layer 1702 may be a fiber cement board, wood, or masonry. Other examples of materials may also used in construction of this layer. The layer 1702 may be two perpendicular sheets coupled together to cover faces 1703 and 1705 of the first structural components.

The first and second structural components 1704 and 1706 are load bearing and seismic relief components. In this regard, they may be sheet metal panels that are bolted or otherwise secured together by the bolts 1710 and 1712. The components 1704 and 1706 may be formed in any shape so as to have corners and intersections. As shown in FIG. 17, the component 1704 fits into the component 1706 and both are formed of two perpendicular panels.

The second protective layer 1708 may be used for interior cladding. In this respect, it may be a gypsum wallboard or a fiber cement board. Other examples of materials may also be used for the third protective layer. The layer 1702 may be two perpendicular sheets coupled together to cover faces 1703 and 1705 of the first structural components.

Figure 18:
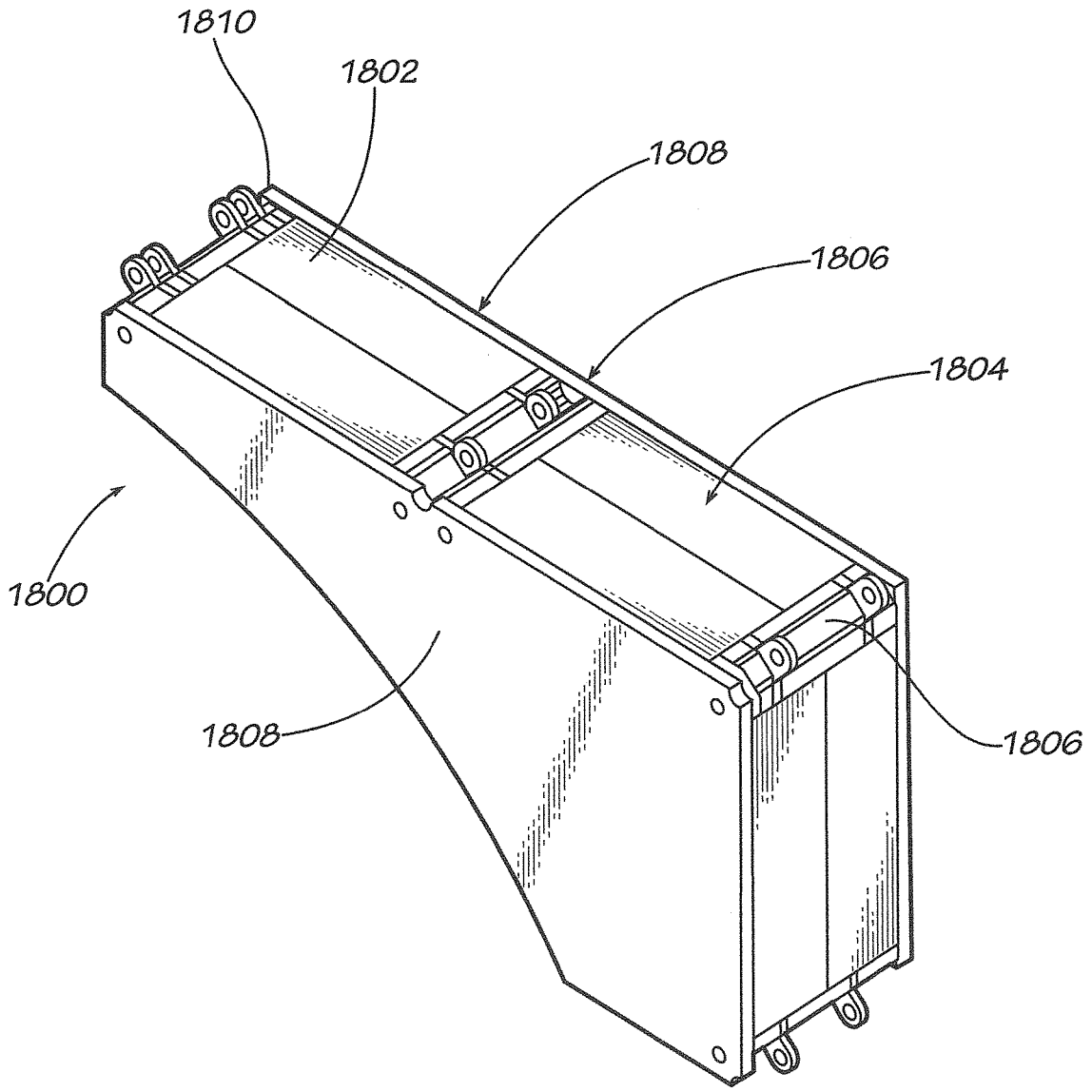
FIG. 18 is a perspective diagram of a structure according to the present invention.

Referring now to FIG. 18 another example of a structure 1800 formed using the present approaches is described. In this example, a non-structural support structure 1800 (e.g., a block) is formed in part by cutting a larger structure (not shown) to shape this structure into the desired dimensions. The cutting of the larger structure, among other advantages, allows door and window openings (as well as other architectural features) to be formed and dimensioned to meet precise tolerances. The structure 1800 includes a first insulation panel 1802 and a second insulation panel 1804. The panels 1802 and 1804 are coupled together via connection brackets 1806. An exterior cladding layer 1808 is coupled to the panel 1804 and an interior cladding layer 1810 is coupled to the panel 1802. These components and their construction has been described elsewhere in this application and will not be repeated again here. In this example, the protective layers and insulation layers are laminated together. The connection brackets provide connectivity to adjacent blocks. To resist edges from breaking under loading conditions, reinforcing embedded in the cladding is attached to the embedded connector pins.

Figure 19A:
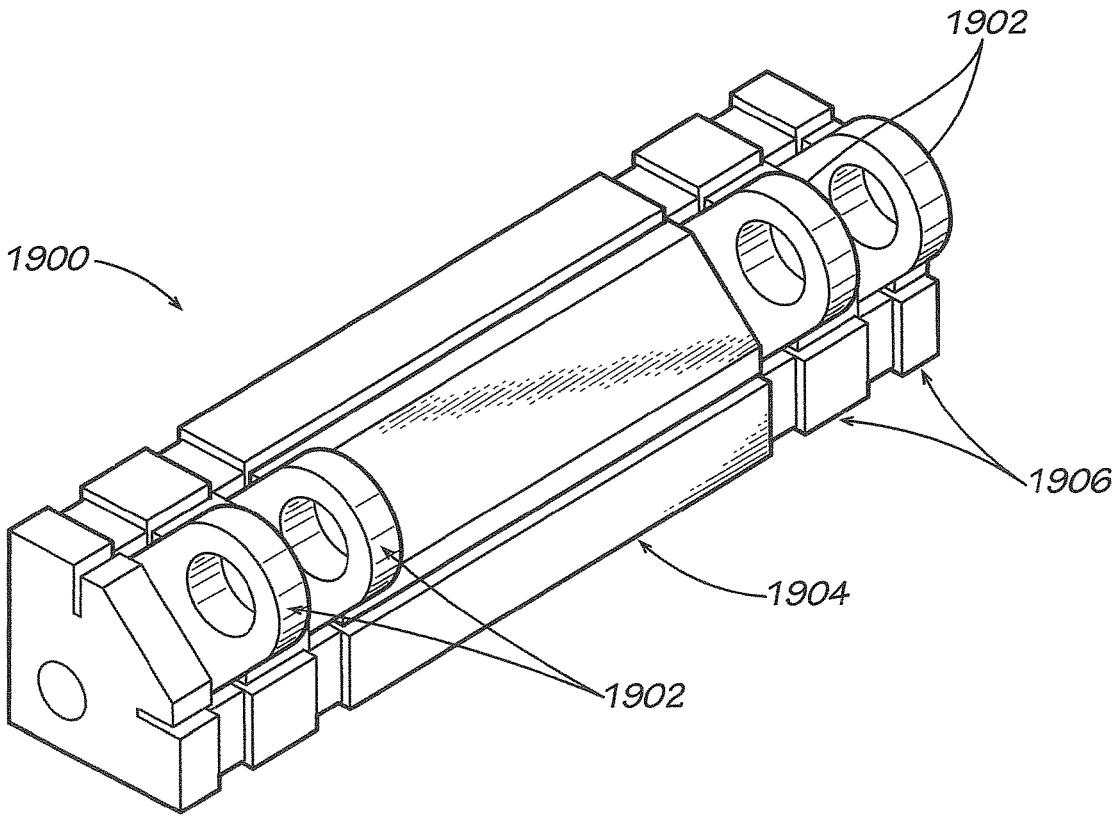
FIGS. 19A and 19B are perspective diagrams of block-to-block connector arrangements according to the present invention.
Figure 20:
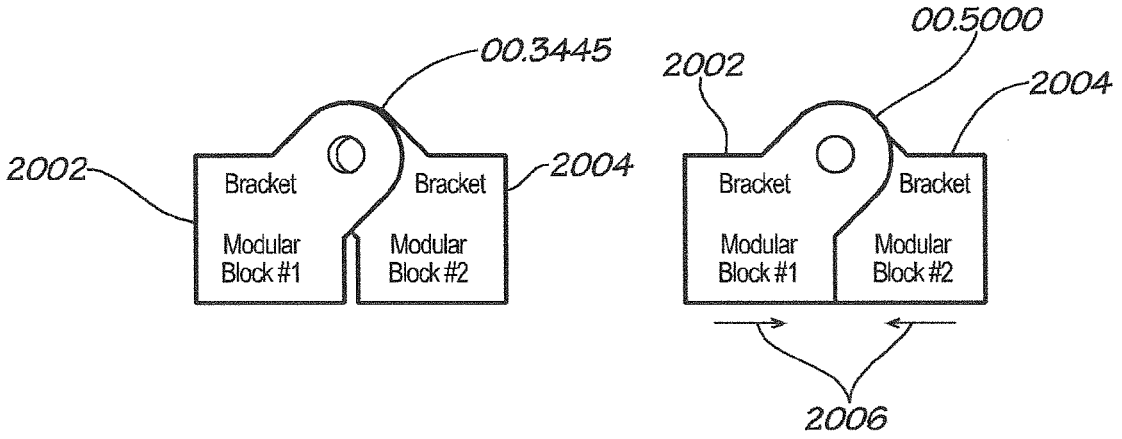
FIG. 20 is a diagram showing a block-to-block connection according to principles of the present invention.

Referring now to FIG. 19A one example of an assembly bracket 1900 or strut is described. The bracket is coupled to or formed as part of a block and includes block-to-connector brackets 1902, a composite strut 1904, and spacers 1906. Using this arrangement (and as shown in FIG. 20), two blocks are coupled together. In this example, connector brackets 1902 from another block are fitted between the connector brackets 1902 of the present block 1900. The connector brackets 1902 are arranged on the block 1900 to avoid connector brackets on adjacent blocks. The spacers 1906 maintain the position of the brackets 1902 so that these do not interfere with the brackets on other blocks. The spacers 1906 may be integrally formed with the block 1900 or may be snapped or otherwise attached to the block 1900. Holes or other openings extend through the bracket connectors. Once two blocks are aligned, a pin, bolt, or other connector (e.g., the expansion bolt of FIG. 21) is placed through the holes and adjusted to secure the two blocks together.

Figure 19B:
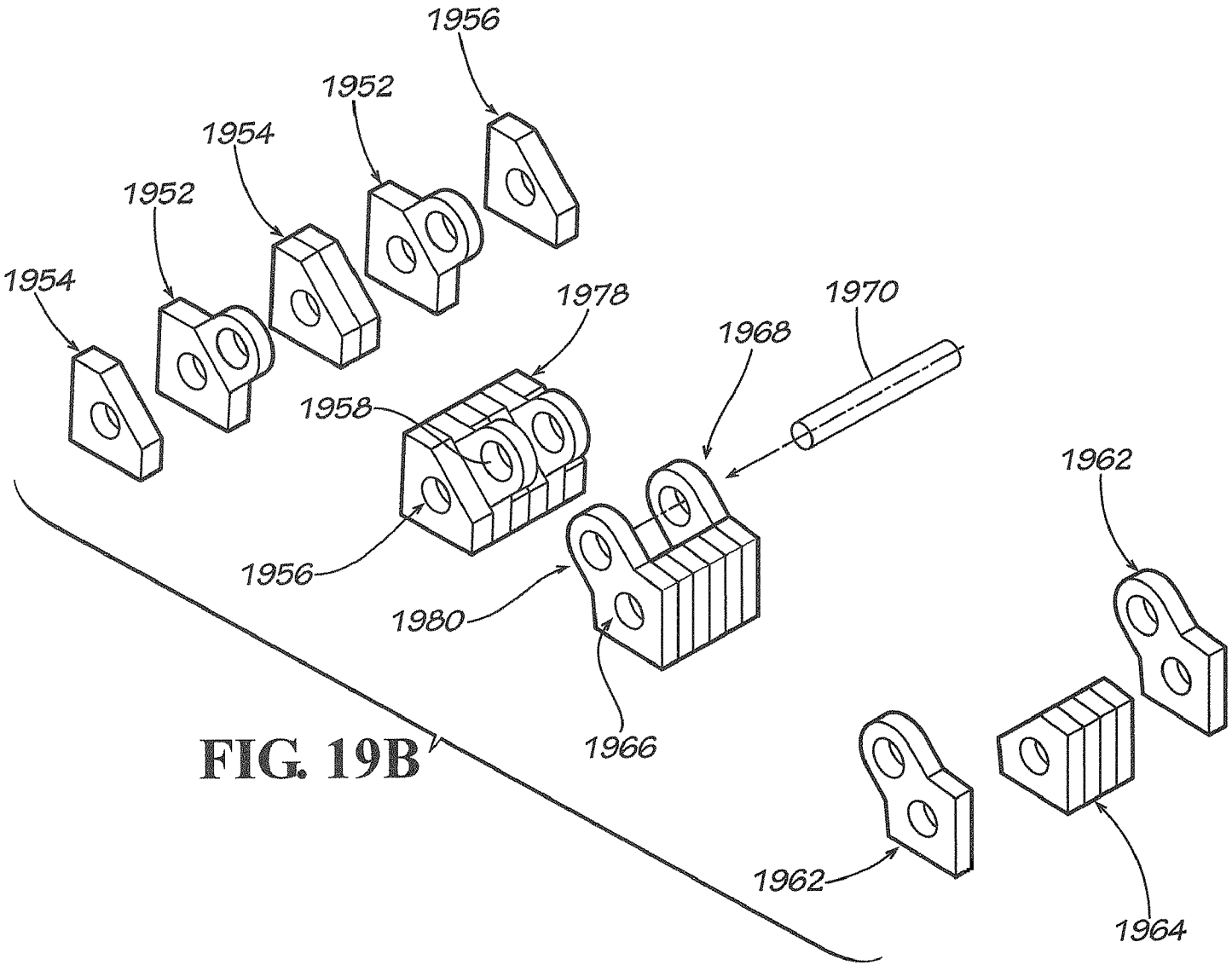

Referring now to FIG. 19B, a detailed view of the connector arrangement between two blocks is described. In this figure, for clarity only the connector brackets, pins/bolts/and spacers are shown. However, it will be understood that these are incorporated with or in some other manner attached to two separate blocks that are to be connected together. In this example, the spacers allow the positioning of the connector brackets in a way that facilitates connector brackets on adjacent block assemblies to align without interference. A connector pin (e.g., an expansion bolt) is then inserted into holes in the connector brackets to secure adjacent blocks together.

More specifically, a first connector assembly 1978 for a first block includes connector brackets 1952, and spaces 1954. Bolt holes 1956 extend through the spacers and brackets and mounting holes 1958 extend through the brackets. A second connector assembly 1980 for a second block includes connector brackets 1962, and spaces 1964. Bolt holes 1966 extend through the brackets and spacers and mounting holes 1968 extend through the brackets. Bolts extend through the bolt holes 1956 and 1966 to mount the bracket assembly to the block or panel.

The connector brackets 1952 and 1962 are configured to overlap. A connector pin 1970 (e.g., and expansion bolt) inserts through the bracket connectors to hold the two assemblies (and thereby the two blocks) together. It will be appreciated that the size, dimensions, and number or brackets and spacers can vary according the needs of a particular structure or system.

Referring now to FIG. 20 one example of a block-to-block connection using one of the blocks of FIGS. 19A and B is described. A first block 2002 is moved into place against a second block 2004 in the direction indicated by the arrows 2006. The bracket connector portions of the first block 2002 fit in between the bracket connector portions of the second block 2004. Openings extend through the bracket connectors of each block and these openings align with each other when the two blocks are pushed together. A pin or other connector (e.g., the expansion bolt of FIG. 21) can then be slid through the holes to secure the arrangement.

Referring now to FIG. 21 one example of an expansion bolt 2100 is described. The expansion bolt includes a nut 2102, an expansion sleeve 2104, an expansion pin 2106, and a bolt 2108. The nut 2102 secures the bolt 2108. As the bolt 2108 is tightened (i.e., moved further into the sleeve 2104, the bolt 2108 presses the expansion pin 2106 outward and that expansion, in turn, presses the expansion sleeve 2104 that thereby expands the diameter of the expansion bolt 2100. The expansion bolt increases in diameter as it is tightened, forcing modular blocks to draw tightly together. The blocks have a predetermined tolerance allowing some movement when coupled together. This arrangement provides an adjustable connector that provides a rigid connection between block. This connection arrangement accounts for varying tolerances in that the bolt can be tightened as desired or as needed to provide the appropriate or desired rigidity for a particular connection. It will be appreciated that this is one example of a connection arrangement that provides these desired features of the structure (e.g., rigid block-to-block connections to provide structural stability and an adjustable connection arrangement) and that other connection arrangements providing the same or similar functions may also be used.

Figure 22:
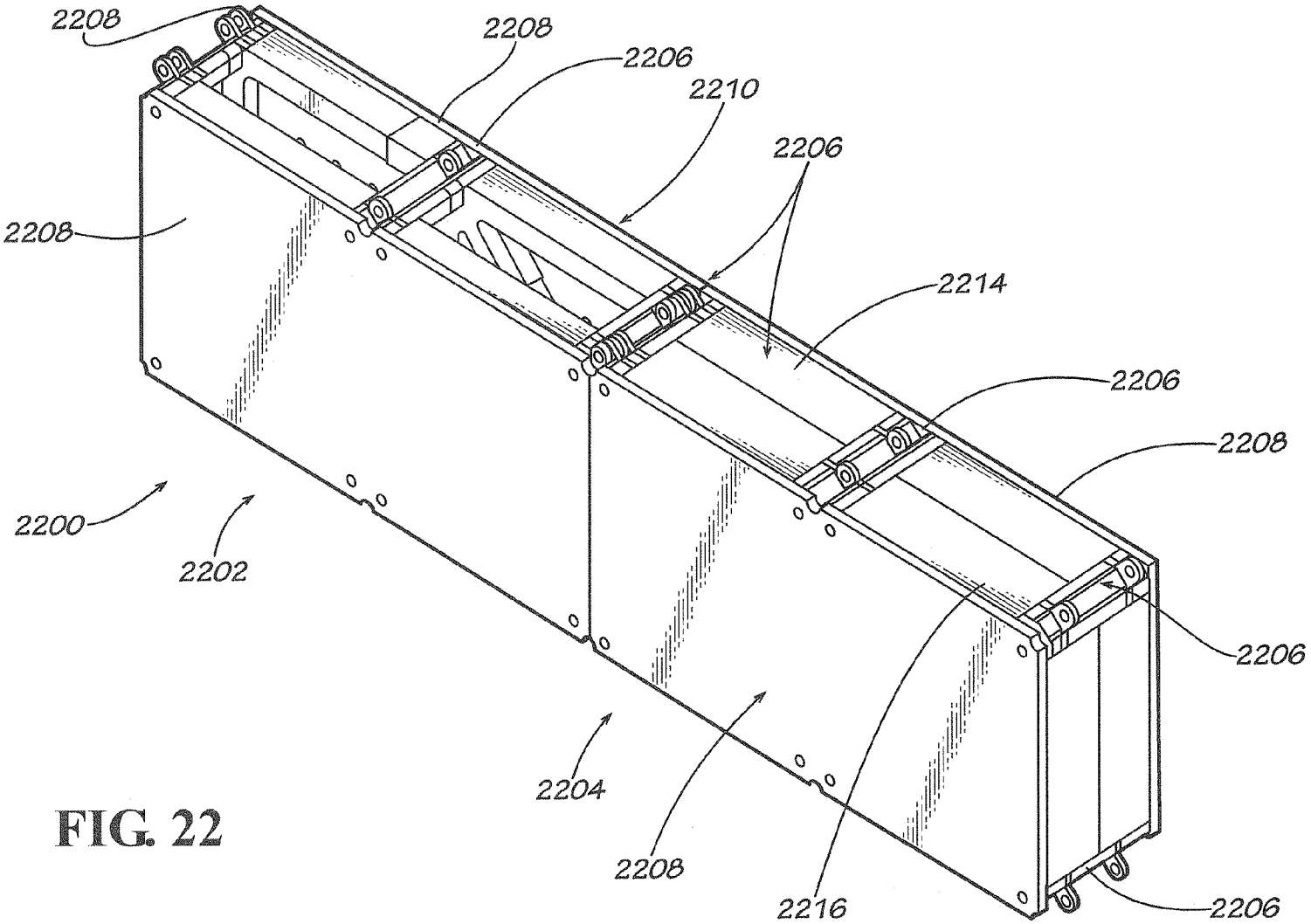
FIG. 22 is a perspective diagram of a structure according to the present invention.

Referring now to FIG. 22 another example of a structure 2200 is described. This may be a portion of a wall with other blocks (not shown). The structure 2200 includes a first block 2202 and a second block 2204 secured together with a bracket arrangement 2206. The first block 2202 includes a strut and gusset plate space frame 2210 (as described with respect to FIG. 13). The second block 2204 is an improved modular insulated panel (as described with respect to FIG. 15) including two sub-panels 2214 and 2216. Each block has outer layers 2208. The layers 2208 may include triangulated reinforcement (e.g., in the form of a triangulated mesh that is incorporated or embedded into the layer 2208) to provide strength.

Figure 23:
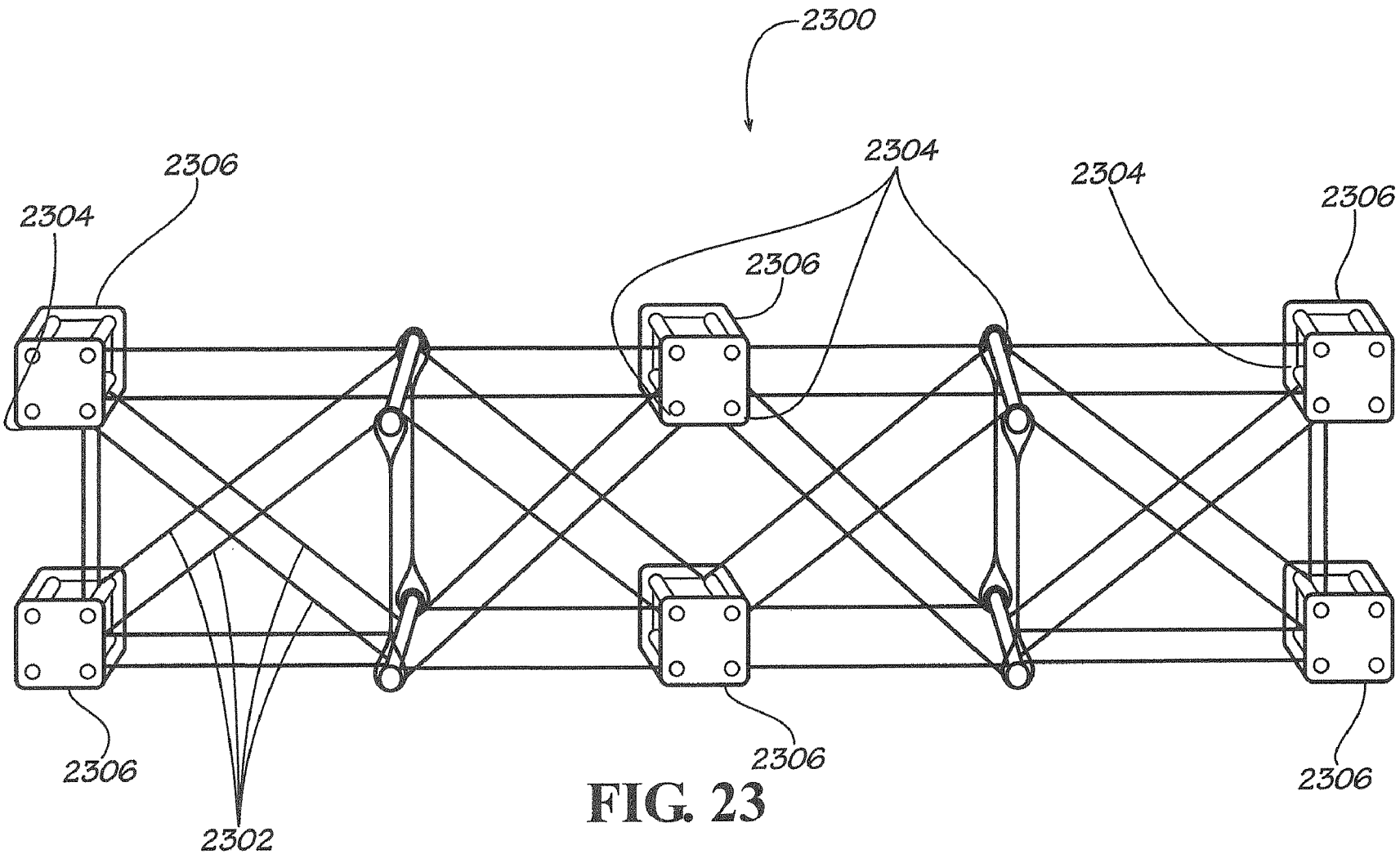
FIG. 23 is a diagram showing another example of a structural component according to principles of the present invention.

Referring now to FIG. 23, one example of a structural component 2300 (e.g., a block as described elsewhere herein). The component 2300 includes tensile reinforcement members 2302 (e.g., metal wire, composite fiber, glass fiber, to mention a few examples) that is wound around pins 2304. Some of the pins 2304 are incorporated into or around connection blocks 2306. The pins connect the structure (e.g., the block) to other structures to form larger structures (e.g., walls, floors, ceilings, or portions of these elements). The winding and/or attachment of the tensile reinforcement members 2302 to the pins provides strength and rigidity to the block 2300 as described in greater detail below. It will be understood that materials such as concrete, foam, insulation, and so forth can be formed around the tensile reinforcement members 2302 as described elsewhere herein to provide struts or cross bars. Alternatively, the whole structure 2300 can be formed as one solid material block.

In one advantage of the arrangement of FIG. 23, forces that act on the edges of the structure 2300 and/or at the pins 2304 and that would damage the structure 2300 or disconnect the structure 2300 from other structures are resisted and damage to the structure is eliminated or minimized. In particular, the connection of the tensile reinforcement members 2302 (e.g., wire) resists forces that act at the edges of the structure 2300 and would act to break the connections between the structure 2300 and other structures or tear the structure 2300 apart. It will be understood that the disposition, dimensions, and layout of the tensile reinforcement members 2302, the connection as between this member and the pin 2304, and the material encasing the members 2302 may vary.

Figure 24:
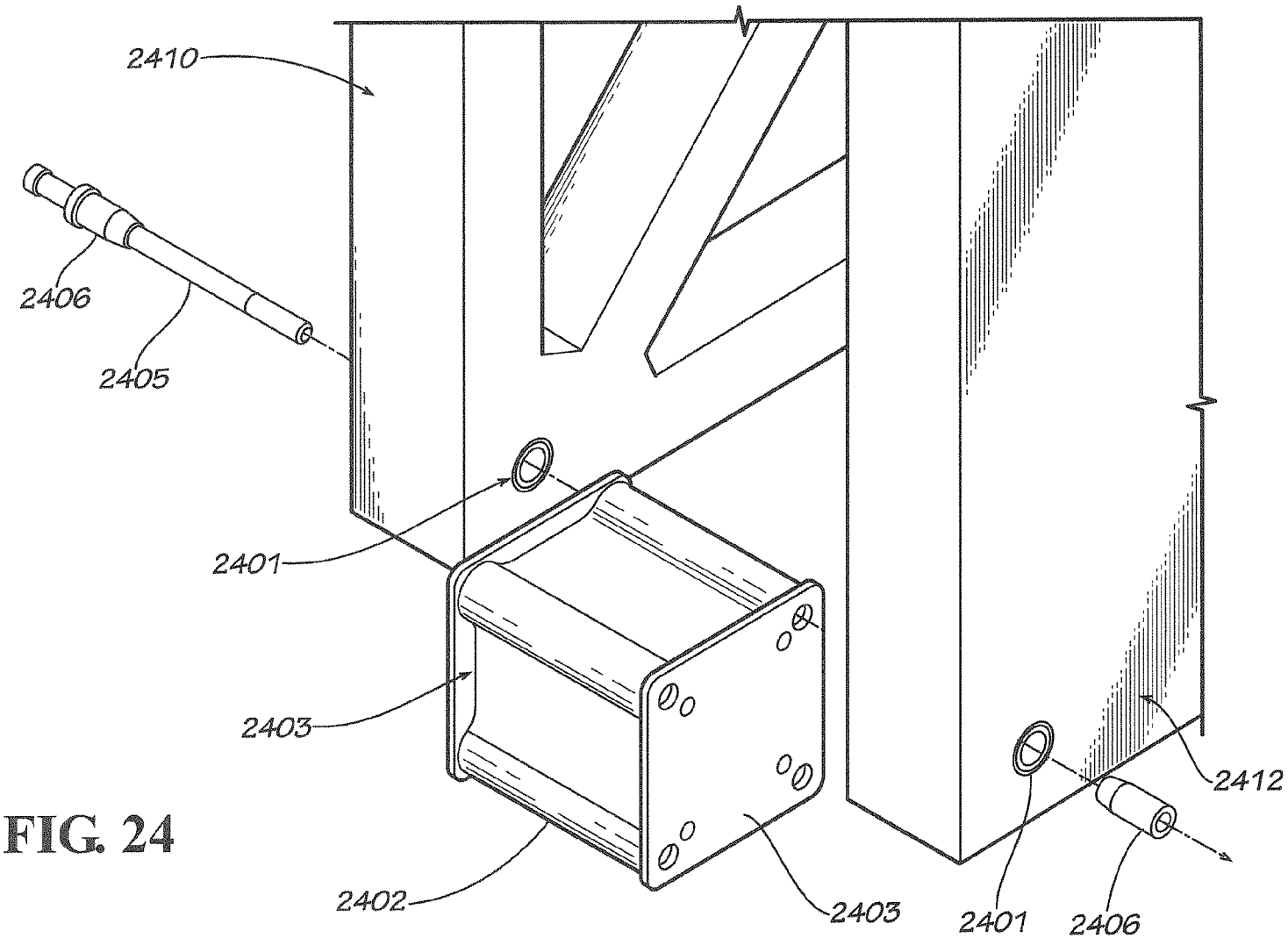
FIG. 24 is a diagram showing another example of a connection arrangement according to principles of the present invention.

Referring now to FIG. 24, another example of a connecting arrangement between blocks or block components 2410 and 2412 (shown in any of the arrangements described herein) is described. Composite insulated and moment connector box 2402 includes a cylindrical insert or sleeve 2401 (that is hollow) that extends though panels 2403. In one example, panel 2403 is a metal plate on each end of composite block 2402. These plates have tapered holes. Connector pins 2401 are embedded into panels 2410 and 2412. Tapered pins 2406 fit into the connector 2404. One of the tapered pins 2406 is threaded so when the bolt is tightened the tapered pins 2406 force alignment with the tapered holes in the metal plates 2403.

The box 2402 is integrally formed with or attached to the block component 2410. A bolt 2405 is fitted into the pin/connector and fit into place. Using this approach (and another bolt opposite bolt 2405 that connects to the component 2412), adjacent blocks or block components 2410 and 2412 can be connected together in a secure and rigid connection. Other examples of connection arrangements may also be used to provide a rigid connection between the blocks or block components.

In many of these examples, a first block performs a structural function while the second block does not perform a structural function. In this regard, the same configuration of blocks need not be used throughout the entire structure (i.e., the function and structure of particular blocks used in the structure may vary from location to location within the structure). Consequently, blocks providing structural reinforcement properties or resistive to certain forces may be used in some portions of the structure while other blocks having other properties may be used in other areas of the structure. In so doing, great flexibility is provided in designing a particular structure and costs are significantly decreased since the same type of block may be used throughout the entire structure. The blocks may also be of non-uniform size and may be configured (e.g., cut) into a variety of different shapes. As described elsewhere herein, a grid pattern (e.g., in a blueprint format) of a structure can be created that assigns coordinates to particular blocks and allows users to assemble the blocks into the overall structure quickly and efficiently. This grid pattern may be generated manually or automatically.

As mentioned, structures using the blocks described herein can be easily and automatically designed and suitable construction documents (e.g., blueprints and part lists) created to aid in the assembly of these structures. In one example, an architect or other designer may enter various design parameters (e.g., forces to be resisted, utilities to be used, dimensions, and so forth) of a structure to be built (e.g., a house). For example, an architect can create a virtual building and/or otherwise enter these into a computer via a suitable user interface (e.g., a keypad on a personal computer). A process may be executed whereby the automatic selection of blocks having different configurations is performed. This process may also create a parts list indicating the blocks or block types to be used, their number, their configuration. Blueprints (e.g., using a grid pattern) can also automatically be generated which show the location of particular blocks.

Many advantages may be obtained using this approach. For example, the architect is in a controlling role and maintains this roll during the construction process. The construction process is streamlined and delivery times are increased. When design changes are made, a materials list and orders are updated immediately.

Figure 25:
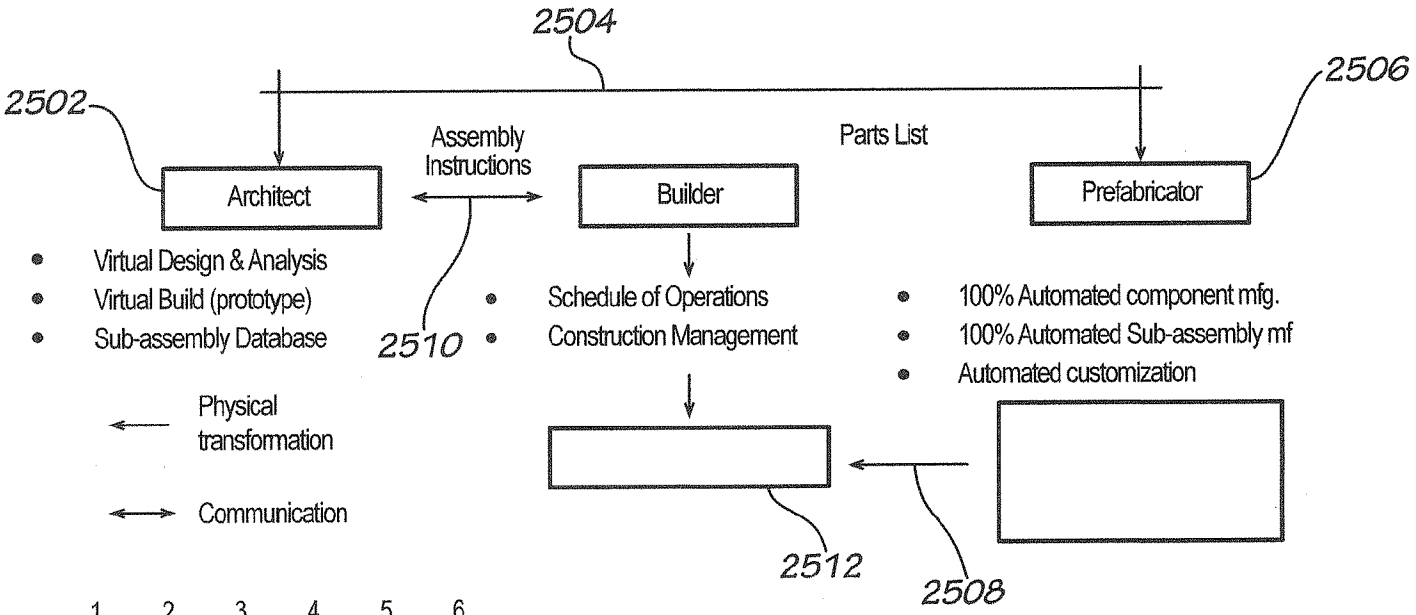
FIG. 25 is a diagram showing one example of an automated construction approach according to principles of the present invention.

Referring now to FIG. 25, one specific example of such an approach is described. The architect performs virtual design and analysis, builds a virtual prototype, and utilizes a sub-assembly database at step 2502. This may be accomplished, for example, using a personal computer. A parts list 2504 is formed by the computer and sent to a prefabricator.

The prefabricator at step 2506 builds, for example, wall assembly, floor assembly and roof assembly, and these are sent at step 2508 to a building site where the builder consults assembly instructions 2510 (also sent by the architect or other designer) to assemble the building at step 2512.

Figure 26:
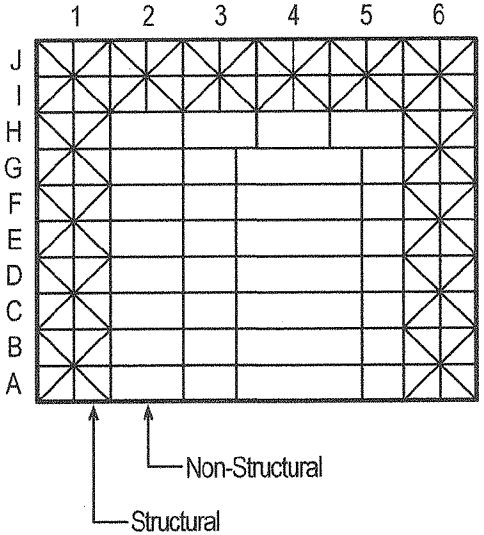
FIG. 26 is a diagram showing an example of a building structure assembled according to principles of the present invention.

Referring now to FIG. 26, one example of a structure constructed according to the present approaches is described. A grid system (with one direction of the grid using numerical labels and the other direction using alphabetic labels) is used. For example, block A-1 refers to the block at the lower left of the structure. Some blocks (shown with cross struts) provide structural reinforcement functions (e.g., clock A-1) while others do not (e.g., block A-2). As can be seen, not all blocks provide the same functions and the overall wall structure can use, for example, blocks providing structural reinforcement properties in only the locations in the structure where these properties are desired or needed. Consequently, the overall cost of the structure is reduced since the use or deployment of expensive components reduced to an absolute minimum level.

Thus, building blocks are provided that have a high degree of design and structural flexibility and have uses that are not limited to specific architectural designs or floor plans. Material, labor, and construction costs are reduced in manufacturing and assembling the blocks. The present approaches also allow for structural openings (e.g., windows and doors) to be placed almost anywhere in structures formed from the blocks while maintaining structural integrity. The building blocks can be fabricated using automated processes and entire buildings can be prefabricated as building blocks, precut, marked, and palletized for shipping. Consequently, constructing a building is greatly simplified and costs are significantly reduced. Various types of computer software or computer processes may also be used for the design, fabrication, delivery, and construction processes.

Those skilled in the art will recognize that a wide variety of modifications, alterations, and combinations can be made with respect to the above described embodiments without departing from the spirit and scope of the invention, and that such modifications, alterations, and combinations are to be viewed as being within the scope of the invention.

What is claimed is:

1. A block for use in a building panel, the block comprising:

a plurality of layer components, each of the layer components being separately formed from the others, each of the layer components providing a building function selected from the group consisting of: a load-bearing support function, an environmental protection function, and a utility function;

wherein at least one of the plurality of layer components comprises a plurality of protruding members and a plurality of tensile reinforcement members, wherein selected ones of the tensile reinforcement members are wound about selected ones of the protruding members so as to resist forces present or created on edges of the block without the use of a filler material; and such that a constructive material used to form each of the layer components and a configuration of each of the layer components are selected so as to allow the building panel to meet at least one predetermined criteria when the block is disposed in the building panel and coupled to other blocks.

2. The block of claim 1 wherein the at least one predetermined criteria is selected from the group consisting of: a structural support requirement, an environmental protection requirement, a utility conduit requirement, and an aesthetic requirement.

3. The block of claim 1 wherein the constructive material of each layer component is selected to resist a force selected from the group consisting of: a bending force, a tension force, a compression force, a torsion force, a shear force, and a thermal force.

4. The block of claim 1 wherein at least one of the layer components comprises a protective layer.

5. The block of claim 4 wherein constructive material of the protective layer is selected from the group consisting of: a vapor barrier material, a waterproofing barrier material, and a breathable wrap material.

6. The block of claim 1 wherein at least one of the layer components comprises a utility component.

7. The block of claim 6 wherein the utility component is selected from the group consisting of: insulation, an electrical conduit, and a plumbing conduit.

8. The block of claim 1 wherein at least one of the layer components comprises a load bearing component.

9. The block of claim 8 wherein the load bearing component is constructed from a material selected from the group consisting of: steel, plywood, plastic, fiberglass, and concrete.

10. The block of claim 1 wherein the plurality of layer components act in composite action.

11. A building panel, comprising:

a plurality of blocks coupled together via a plurality of coupling mechanisms, the blocks being coupled together directly via the coupling mechanisms and without the use of an intervening building structure;

each of the plurality of blocks comprising:

a plurality of layer components, each of the layer components being separately formed from the others, each of the layer components providing a building function within the building panel, the building function selected from the group consisting of: a load-bearing support function, an environmental protective function, and a utility function;

wherein at least one of the plurality of layer components comprises a plurality of protruding members and a plurality of tensile reinforcement members, wherein selected ones of the tensile reinforcement members are wound about selected ones of the protruding members so as to resist forces created or present on edges of the building panel without the use of a filler material; and such that a constructive material and a configuration of each of the layer components are selected to allow the building panel to meet at least one predetermined criteria when each of the blocks is disposed in the building panel and coupled to other blocks.

12. The building panel of claim 11 wherein at least some of the coupling mechanisms comprise a locking pin arrangement.

13. The building panel of claim 11 wherein the building panel is a building component selected from the group consisting of: a wall panel, a truss, a floor panel, an interior load bearing panel, an exterior load bearing panel, an interior non-load bearing panel, an exterior non-load bearing panel, and a floor.

14. A block for use in a building panel, the block comprising:

a first layer component, the first layer component configured to provide a first building function, the first layer component being constructed from a first material;

a second layer component formed separately from the first layer component and connected to the first layer component, the second layer component configured to provide a second building function, the second layer component constructed from a second material;

a third layer component formed separately from the first layer component and the second layer component, the third layer component connected to the second layer component, the third layer component configured to provide a third building function, the third layer component constructed from a third material;

wherein at least one of the plurality of first layer component, second layer component, or third layer component comprise a plurality of protruding members and a plurality of tensile reinforcement members, wherein selected ones of the tensile reinforcement members are wound about selected ones of the protruding members that act to resist forces created or present on edges of the component without the use of a filler material;

such that the second layer component is disposed between the first layer component and the third layer component;

such that the first building function, the second building function, and the third building function are selected from the group consisting of: a load-bearing support function, an environmental protection function, and a utility function; and such that a constructive material and a configuration of each of the first layer component, the second layer component, and the third layer component are selected to allow the building panel to meet at least one predetermined criteria when the block is disposed in the building panel and coupled to other blocks.

15. The block of claim 14 wherein the at least one predetermined criteria is selected from the group consisting of: a structural support requirement, an environmental protection requirement, a utility conduit requirement, and an aesthetic requirement.

16. The block of claim 14 wherein at least one of the first material, the second material, and the third material is selected to resist a force selected from the group consisting of a bending force, a tension force, a compression force, a torsion force, a shear force, and a thermal force.

17. The block of claim 14 wherein at least one of the first layer component, second layer component, and third layer component comprises a protective layer.

18. The block of claim 17 wherein the protective layer is constructed from a material selected from the group consisting of: a vapor barrier material, a waterproofing barrier material, a durable barrier material, and a breathable wrap.

19. The block of claim 14 wherein at least one of the first layer component, second layer component, and third layer component comprises a utility component.

20. The block of claim 19 wherein the utility component is selected from the group consisting of: insulation, an electrical conduit, and a plumbing conduit.

21. The block of claim 14 wherein at least one of the first layer component, second layer component, and third layer component comprises a load bearing component.

22. The block of claim 21 wherein the load bearing component is constructed from a material selected from the group consisting of steel, plywood, plastic, fiber glass and concrete.

23. The block of claim 14 wherein the first material, second material, and third material are different from the others.

24. The block of claim 14 wherein at least two of the first material, second material, and third material are the same.

* * * * *